US010850908B2

(12) United States Patent
Monaghan et al.

(10) Patent No.: US 10,850,908 B2
(45) Date of Patent: Dec. 1, 2020

(54) PACKAGING AND SHIPPING BLOCKS FOR FLAT-PANEL PRODUCTS

(71) Applicant: Sternbloc LLC, Cleveland, OH (US)

(72) Inventors: Michael G. Monaghan, Hudson, MI (US); Kenneth R. Johnson, Cleveland, OH (US)

(73) Assignee: Sternbloc LLC, Cleveland, OH (US)

( * ) Notice: Subject to any disclaimer, the term of this patent is extended or adjusted under 35 U.S.C. 154(b) by 0 days.

(21) Appl. No.: 16/545,467

(22) Filed: Aug. 20, 2019

(65) Prior Publication Data

US 2020/0062481 A1 Feb. 27, 2020

Related U.S. Application Data

(60) Provisional application No. 62/720,345, filed on Aug. 21, 2018.

(51) Int. Cl.

| | |
|---|---|
| ***B65D 81/05*** | (2006.01) |
| ***B65D 5/50*** | (2006.01) |
| ***B65B 55/20*** | (2006.01) |

(52) U.S. Cl.

CPC ..... *B65D 81/053* (2013.01); *B65B 55/20* (2013.01); *B65D 5/50* (2013.01)

(58) Field of Classification Search

CPC ..... B65D 5/50; B65D 81/02; B65D 81/05; B65D 81/053; B65D 85/30; B65D 85/48

USPC ..... 206/449, 453, 454, 586

See application file for complete search history.

(56) References Cited

U.S. PATENT DOCUMENTS

| | | | | |
|---|---|---|---|---|
| 4,785,936 A * | 11/1988 | Shpigelman | B65D 25/107 | 206/449 |
| 5,509,534 A * | 4/1996 | Taravella | B65D 5/5088 | 206/449 |
| 8,163,370 B2 * | 4/2012 | Kuo | B65D 81/055 | 428/122 |
| 2007/0170077 A1 * | 7/2007 | Weir, III | G11B 33/0472 | 206/308.1 |
| 2010/0147723 A1 * | 6/2010 | Farrell | B65G 49/061 | 206/453 |

* cited by examiner

*Primary Examiner* — Bryon P Gehman

(74) *Attorney, Agent, or Firm* — MacMillan, Sobanski & Todd, LLC

(57) ABSTRACT

Described herein are shipping blocks for packaging and shipping flat-panel products. The blocks have chamfered edges to allow the block to slide across uneven surfaces; at least one of slots or alignment tabs to secure the product to the block; and, walls that are configured to flex when pressure or stress is applied to the block.

23 Claims, 19 Drawing Sheets

PACKAGING AND SHIPPING BLOCKS FOR FLAT-PANEL PRODUCTS

RELATED APPLICATIONS

This application claims priority to U.S. Provisional Application Ser. No. 62/720,345 filed under 35 U.S.C. § 111(b) on Aug. 21, 2018, the disclosure of which are incorporated herein by reference in their entireties.

TECHNICAL FIELD

This invention relates to a window packaging and shipping block that prevents and/or lessens damage to windows during transit.

BACKGROUND

Products that are generally narrow in depth and formed in a sheet, plate or panel construction such as doors, windows, mirrors, and raw sheet materials including glass, plastic, stone, and various composite materials can be difficult to package and ship. These types of products, generally referred to as "panel products" or "flat-panel products" are typically packaged for shipping. Still, such products are liable to be damaged during shipping. These products are often damaged when dropped, particularly when dropped on their corners or edges.

The packaging is typically constructed of a corrugated or paperboard materials, closed-cell extruded polystyrene foam such as Styrofoam®, cardboard, plastic injection molded and blow foamed products. These packaging materials have geometry that does not fully protect all critical performance areas.

These prior art packaging materials require a significant number of different shapes that fit each different type of panel products. Furthermore, to adequately protect the panel product provided within the package, each package must be individually sized to accept the particular product being shipped. Therefore, in production and packaging facilities where a number of different types of products are produced, an equivalent number of different types of shipping cartons must be stocked for packaging, requiring a great deal of storage space and inventory management.

Additionally, in many cases, the packaging is relatively heavy, thereby contributing to increased labor difficulties and expenses in shipping. Furthermore, damage to the internal products remains a problem when using these types of packages, contributing significantly to the cost of both the product and shipping.

There is a need for improved flat-panel packaging that provides safe handling of fragile substrates, and more particularly, to a support that is suitable for cushioning various shaped receptacles containing fragile substrates during transportation.

There is also a need for improved, reliable and efficient packaging to protect windows, doors, and other architectural installments.

BRIEF SUMMARY OF THE INVENTION

Described herein are shipping blocks for packaging and shipping flat-panel products. Non-limiting examples of flat-panel products include architectural windows, doors, entry doors including sliding and French patio doors, automobile windows, photovoltaic devices and solar panels. Also included are products that are generally narrow in depth and formed in a sheet, plate or panel construction such as doors, windows, mirrors, and the like. It is also within the contemplated scope of the present invention that other types of materials, such as raw sheet materials including glass, plastic, stone, and various composite materials, can be secured by the blocks described herein. The blocks generally have a top face, a bottom face, a first end face, a second end face, and internal walls.

The bottom face and the first end face meet at a first leading edge chamfer that provides a sloping surface such that a transitional slope is defined between the first end face and the bottom face.

The bottom face and the second end face meet at an opposing, second leading edge chamfer that also provides a sloping surface such that a transitional slope is defined between the second end face and the bottom face. These leading edge chamfers are configured to allow the block to slide across uneven surfaces.

The top face of the block defines first and second extending portions that are in a spaced apart relationship with each other such that the first and second extending portions define a receiving slot for the plat-panel product.

The top face also defines opposing first and second alignment tabs that extend from the first and second end faces, respectively. The alignment tabs extend at an acute angle from a plane defined by the top face.

The internal walls have an arcuate or curved shape and are configured to flex when pressure/stress is applied to the bottom face or the top face of the shipping block.

In certain embodiments, the bottom face further defines a support platform that is and configured to hold a section of the flat-panel being secured by the block.

In certain embodiments, the internal walls at least partially extends from the top face to the first or second end faces at a point that is adjacent to the bottom face such that the bottom face and the bottom portions of the internal walls define an opening that extends in a generally planar direction from a plane defined by the bottom face.

In certain embodiments, the shipping block further include one or more internal spring walls to provide suspension and flex to the block.

In certain embodiments, the shipping block further include one or more internal cross walls to provide suspension and flex to the block.

In certain embodiments, the shipping block further include one or more internal laterally-extending walls to provide suspension and flex to the block.

In certain embodiments, the receiving slot has a tapered dimension, such that the slot is widest near the top face of the block.

Various objects and advantages of this invention will become apparent to those skilled in the art from the following detailed description of the preferred embodiment, when read in light of the accompanying drawings.

DETAILED DESCRIPTION OF THE INVENTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein.

Non-limiting examples of flat-panel products include architectural windows, doors, entry doors including sliding and French patio doors, automobile windows, photovoltaic devices and solar panels. Also included are products that are generally narrow in depth and formed in a sheet, plate or panel construction such as doors, windows, mirrors, and the like. It is also within the contemplated scope of the present invention that other types of materials, such as raw sheet materials including glass, plastic, stone, and various composite materials, can be secured by the blocks described herein.

Figure 1A:
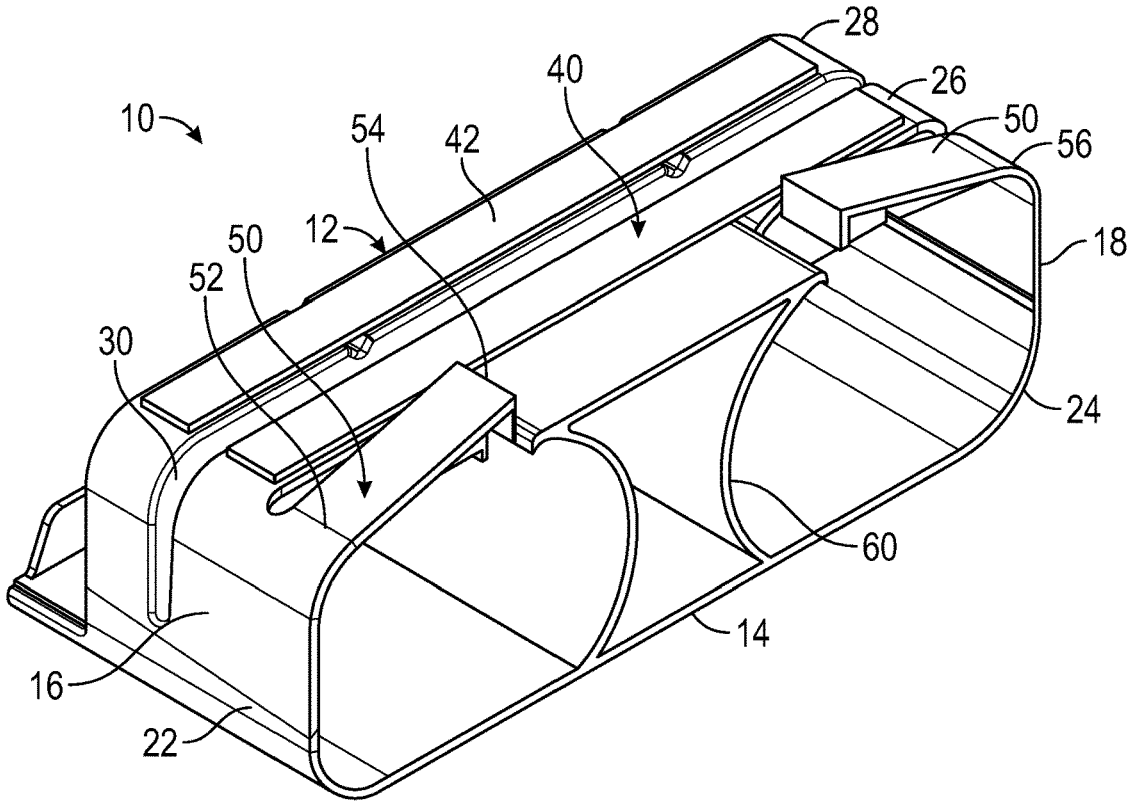
FIG. 1A is a front perspective view of one embodiment of a shipping block.

FIG. 1A is a front perspective view of one embodiment of a shipping block 10. The shipping block 10 generally has a top face 12, a bottom face 14, a first end face 16, and a second end face 18.

The bottom face 14 and the first end face 16 meet at a first leading edge chamfer 22, which provides a sloping surface such that a transitional slope is defined between the first end face 16 and the bottom face 14. Similarly, the bottom face 14 and the second end face 18 meet at an opposing, second leading edge chamfer 24, which also provides a sloping surface such that a transitional slope is defined between the second end face 18 and the bottom face 14. The leading edge chamfers 22, 24 of the block 10 allow the block to slide across dock plates, ramps, gravel, parking lots to provide easy and safe delivery of the product to the job site.

The top face 12 defines first and second extending portions 26 and 28 are in a spaced apart relationship with each other. The first and second extending portions 26, 28 extend from the first end face 16 to the second end face 18. The first and second extending portions define a receiving slot 30. The receiving slot 30 extends from the first end face 16 to the second end face 18. In certain embodiments, the receiving slot 30 can have any desired shape to securely hold the flat-panel product.

The first and second extending portions 26, 28 are configured to receive tape portions 40 and 42, respectively. The tape portions 40 and 42 are two-sided such that the bottoms of the tape portions 40, 42, adhere to the extending portions 26, 28, while the tops of the tape portions 40, 42 adhere to a flat-panel being held within a block 10. It should be understood that, in certain embodiments, tape portions 40 are used to attach the shipping block to the window frame. For example, Stucco Fin, Retro frame and Flat face fin applications normally would use tape to secure the shipping block to the frame; while other nailing fin applications would use the screw type application or tape, as further explained below with reference to screw bosses 164.

The top face 12 also defines opposing first and second alignment tabs 50. As each alignment tab 50 has the same configuration, for ease of explanation, the same numbers will be used to describe the opposing alignment tabs 50. Each alignment tab 50 has a first tab end 52 which extends from the end faces 16, 18 at an acute angle from a plane defined by top face 12. Each alignment tab 50 terminates at a second end 54, which has a downwardly-extending tab portion 56.

The alignment tabs 50 allow the correct placement of the block 10 with respect to either side of the product. For example, when the product is a window, the alignment tabs 50 protect window's nail fin and stucco flanges from being damaged from the sides of the window hitting or running into other object. The alignment tabs prevent any type of nailing fin from damage during shipping or handling. That is, with the alignment tabs on the corner of the window, these alignment tabs on the top surface further protect the window.

The alignment tabs 50 operate independently, such that the block can be used on any corner or along the sides of the window. In use, the alignment tabs 50 individually push down flush to the top face 12 of the block 10 (see FIGS. 9A-9B) such that the block can be used on either left or right corners, and also can be used in the center, of the window. The opposing alignment tabs 50 are also beneficial, as only type of block may be needed for many window packaging requirements.

Figure 1B:
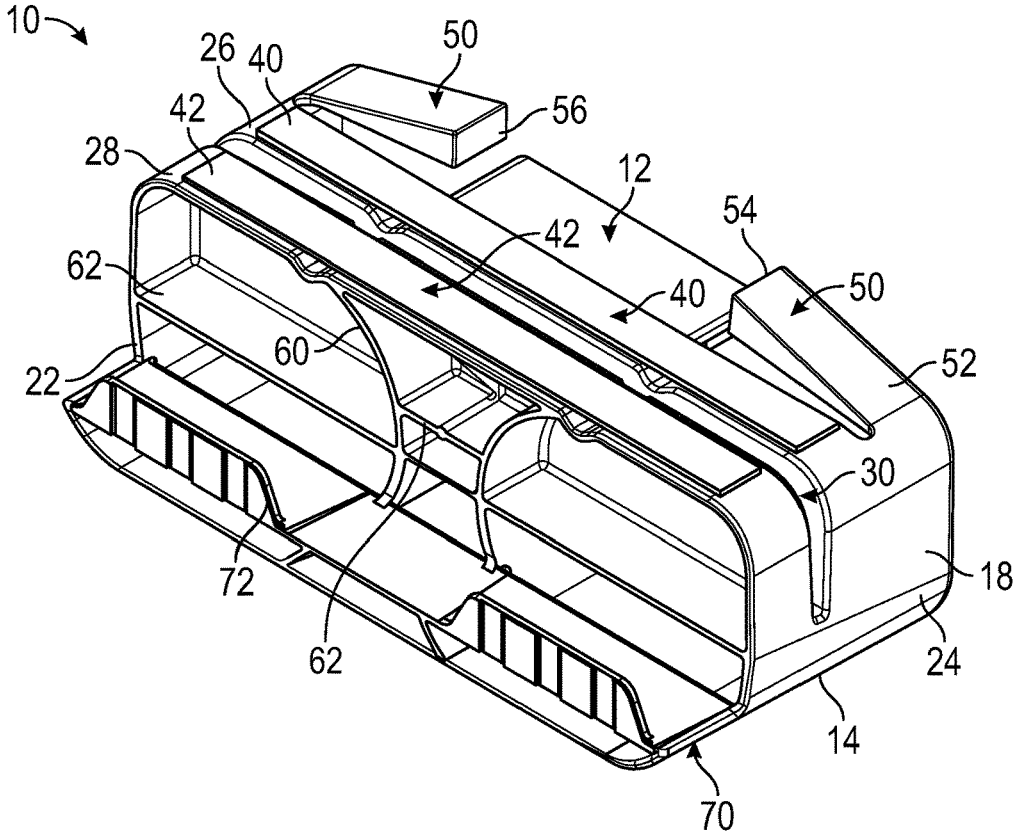
FIG. 1B is a back perspective view of the embodiment shown in FIG. 1A.

Referring now to FIG. 1B, a back perspective view of the embodiment of the shipping block 10 of FIG. 1 is shown. The shipping block 10 further includes opposing internal walls 60. In the embodiment shown, as each internal wall 60 has the same configuration, for ease of explanation, the same numbers will be used to describe the opposing internal walls 60. Each internal wall 60 extends from the top face 12 to the bottom face 14.

The internal walls 60 have an arcuate shape that, when pressure/stress is applied to the bottom face 14 or the top face 12, the shipping block 10 is able to flex. The internal walls 60 have a shape that deforms to cushion impact and vibrations to protect the product.

In certain embodiments, as shown in FIG. 1B, one or more supporting extending walls 62 extend from the internal walls 60 to provide additional support to the block 10.

Also, in certain embodiments, the supporting extending walls 62 can further define one or more bosses/openings 64 which allow a temporary screw to cure the shipping block to a flat-panel being protected. For example, new construction windows often have a nail fin and using a screw to fasten a shipping block. The block 10 can have multiple screw bosses/openings 64 that allow the block to be used on several various frames with different styles and sizes of nail fins.

The bottom face 14 further defines a support platform 70. The platform 70 extends in a generally planar direction from a plane defined by the bottom face 14. The platform 70 includes one or more vertically extending support members 72, which are configured to hold a section of a flat-panel being secured by the block 10.

Figure 2:
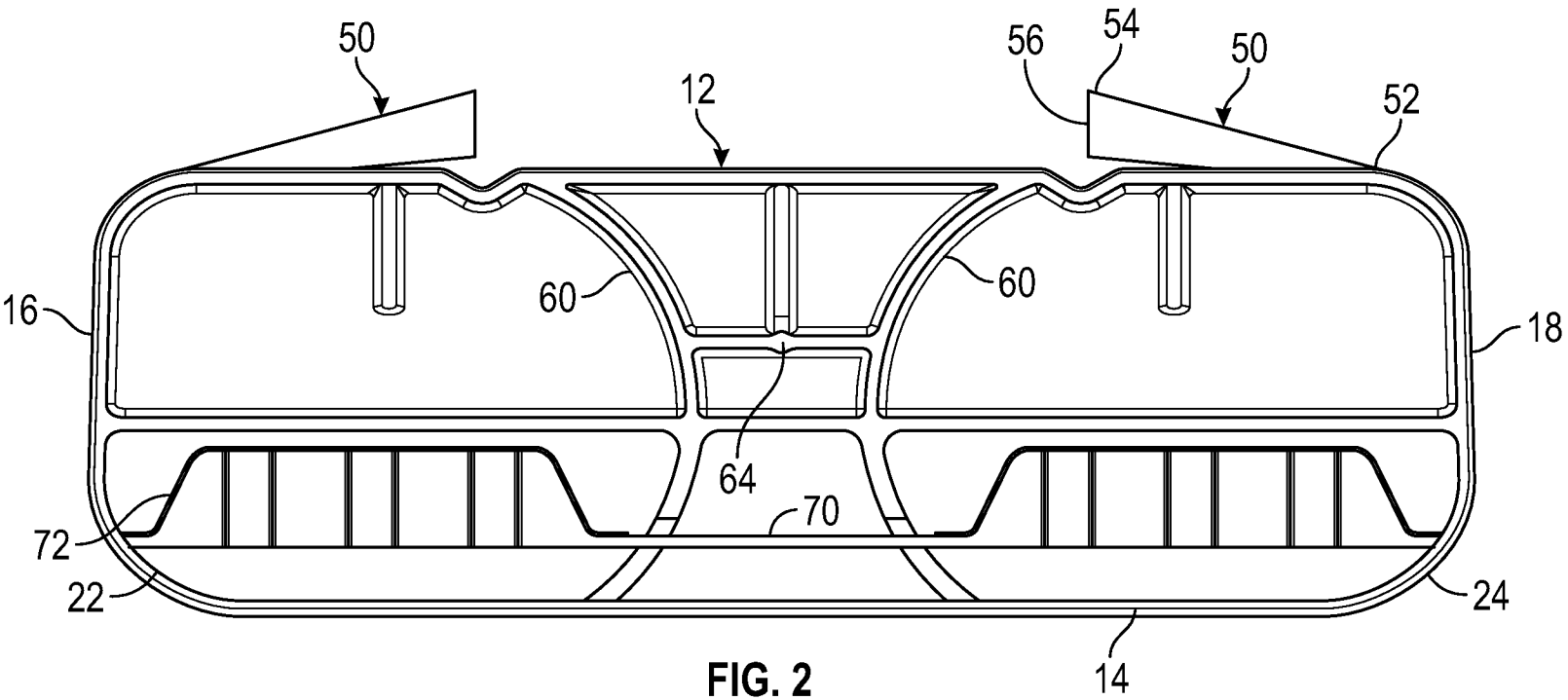
FIG. 2 is a back view of the embodiment shown in FIG. 1A.

FIG. 2 is a back view of the embodiment shown in FIG. 1A showing the platform 70 that is in a spaced apart relationship to the bottom face 16.

Figure 3:
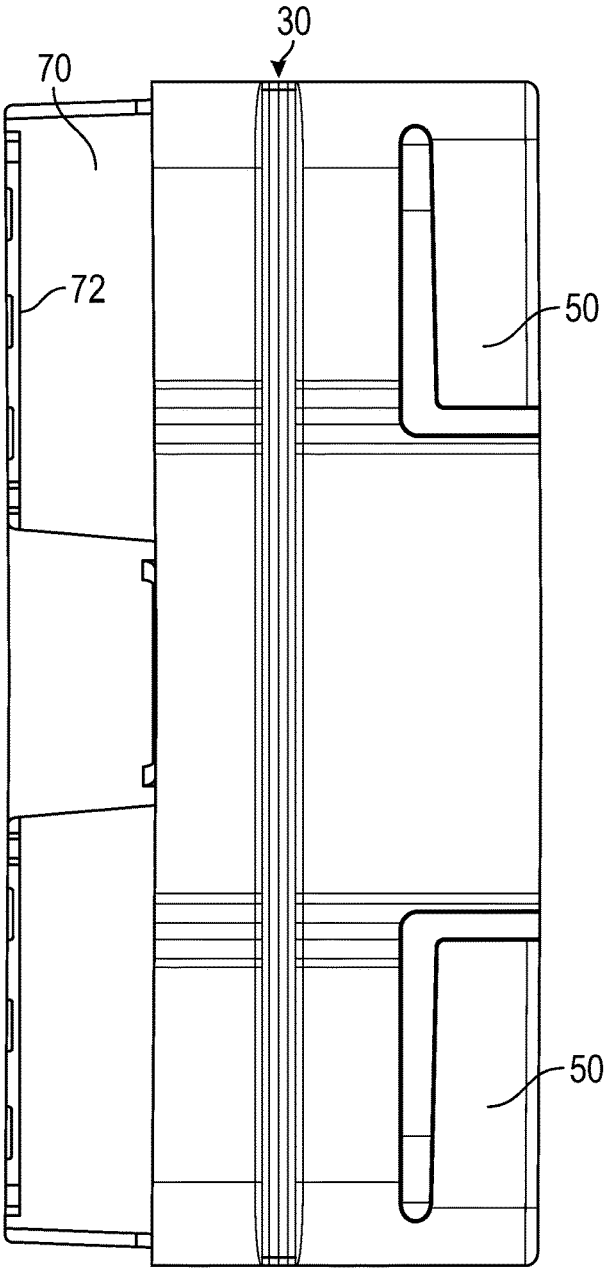
FIG. 3 is a top view of the embodiment shown in FIG. 1A.

FIG. 3 is a top view of the embodiment shown in FIG. 1A showing that the alignment tabs 50 are in a spaced apart relationship to the extending portion 28. Also, in this embodiment, the panel-holding slot 30 can have a tapered dimension, such that the slot 30 is widest near the top face 12.

Figure 4:
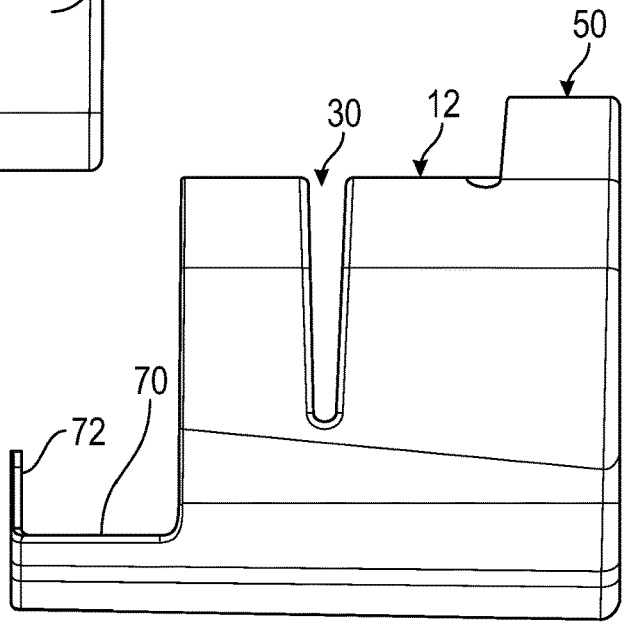
FIG. 4 is an end view of the embodiment shown in FIG. 1A.
Figure 5:
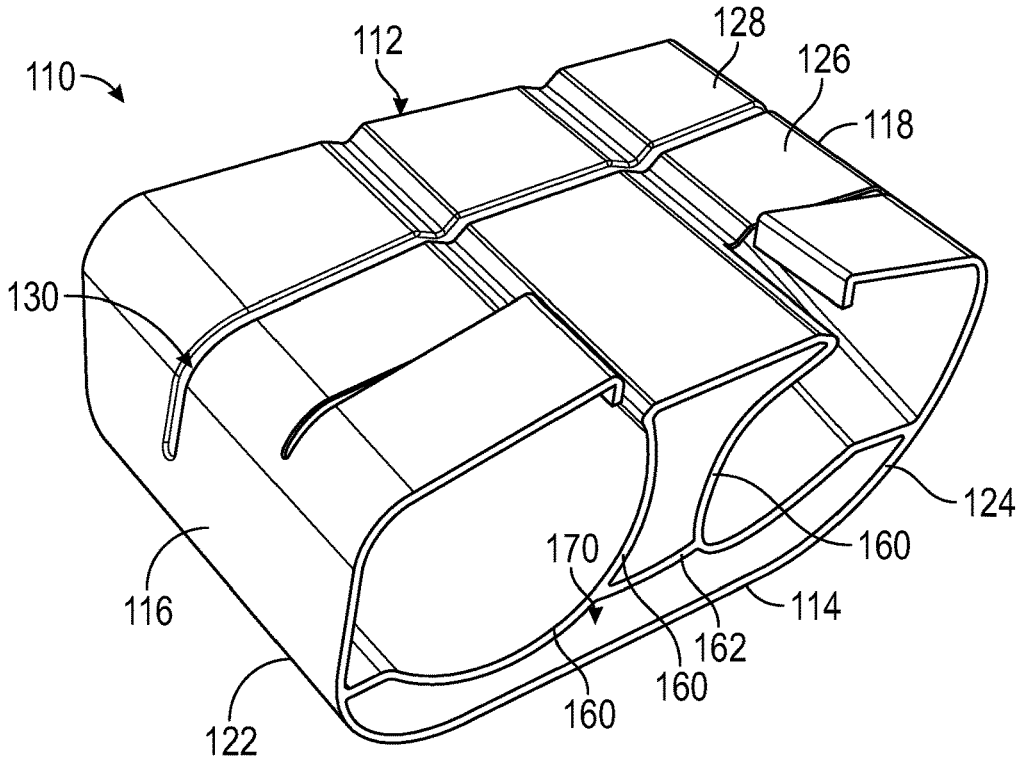
FIG. 5 is a front perspective view of another embodiment of a shipping block.
Figure 6:
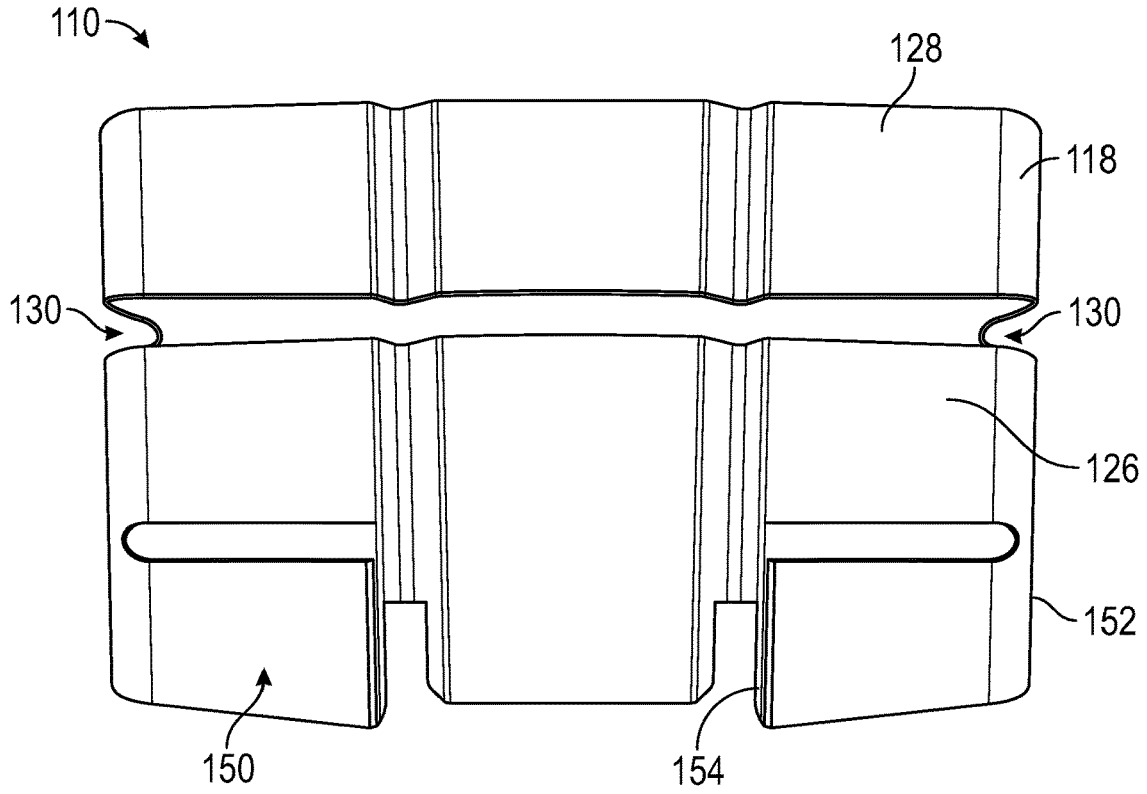
FIG. 6 is a top view of the embodiment shown in FIG. 5.

FIG. 4 is an end view of the embodiment shown in FIG. 1A, showing that the alignment tabs 50 are in a non-parallel relationship with the top face 12.

Referring now to FIGS. 5-8, another embodiment of a shipping block 110 is shown, that has certain similar features as the first block 10. The shipping block 110 generally has a top face 112, a bottom face 114, a first end face 116, and a second end face 118.

The bottom face 114 and the first end face 116 meet at a first leading edge chamfer 122, which provides a sloping surface such that a transitional slope is defined between the first end face 116 and the bottom face 114. Similarly, the bottom face 114 and the second end face 118 meet at an opposing, second leading edge chamfer 124, which also provides a sloping surface such that a transitional slope is defined between the second end face 118 and the bottom face 114. The leading edge chamfers 122, 124 of the block 110 allow the block to slide across dock plates, ramps, gravel, parking lots to provide easy and safe delivery of the product to the job site.

The top face 112 defines first and second extending portions 126 and 128 are in a spaced apart relationship with each other. The first and second extending portions 126, 128 extend from the first end face 116 to the second end face 118. The first and second extending portions define a receiving slot 130. The receiving slot 130 extends from the first end face 116 to the second end face 118. In certain embodiments, the receiving slot 130 can have any desired shape to securely hold the flat-panel product.

The first and second extending portions 126, 128 are configured to receive tape portions (not shown). It is to be understood, however, that the block 110 can also receive tape portions that are two-sided such that the bottoms of the tape portions adhere to the extending portions 126, 128, while the tops of the tape portions adhere to a flat-panel being held within the block 110.

The top face 112 also defines opposing first and second alignment tabs 150. As each alignment tab 150 has the same configuration, for ease of explanation, the same numbers will be used to describe the opposing alignment tabs 150. Each alignment tab 150 has a first tab end 152 which extends from the end faces 116, 118 at an acute angle from a plane defined by top face 112. Each alignment tab 150 terminates at a second end 154, which has a downwardly-extending tab portion 156.

The alignment tabs 150 allow the correct placement of the block 110 with respect to either side of the product. For example, when the product is a window, the alignment tabs 150 protect window's nail fin and stucco flanges from being damaged from the sides of the window hitting or running into other object.

The alignment tabs 150 operate independently, such that the block can be used on any corner or along the sides of the window. In use, the alignment tabs 150 individually push down flush to the top face 112 of the block 110 (see FIGS. 9A-9B) such that the block can be used on either left or right corners, and also can be used in the center, of the window. The opposing alignment tabs 150 are also beneficial, as only type of block may be needed for many window packaging requirements.

The shipping block 110 further includes opposing internal walls 160. In the embodiment shown, as each internal wall 160 has the same configuration, for ease of explanation, the same numbers will be used to describe the opposing internal walls 160.

Each internal wall 160 at least partially extend from the top face 112 to the first or second end faces 116 and 118 at a point that is adjacent to the bottom face 114. The internal walls 160 have an arcuate shape that, when pressure is applied to the bottom face 114 or the top face 112, the shipping block 110 is able to flex. The internal walls 160 have a shape that deforms to cushion impact and vibrations to protect the product.

In certain embodiments, one or more supporting extending walls 162 extend from the internal walls 160 to provide support to the block 110. In certain embodiments, the supporting extending walls 162 can further define one or more bosses/openings 164 which allow a temporary screw to secure the shipping block to a flat-panel being protected. This provides an added benefit since multiple window frame profile utilize different attachment points. Such attachment point must be below installation hole provided by the window manufacturer on the fin. This prevents additional work during the installation process to prevent water leakage.

Figure 7:
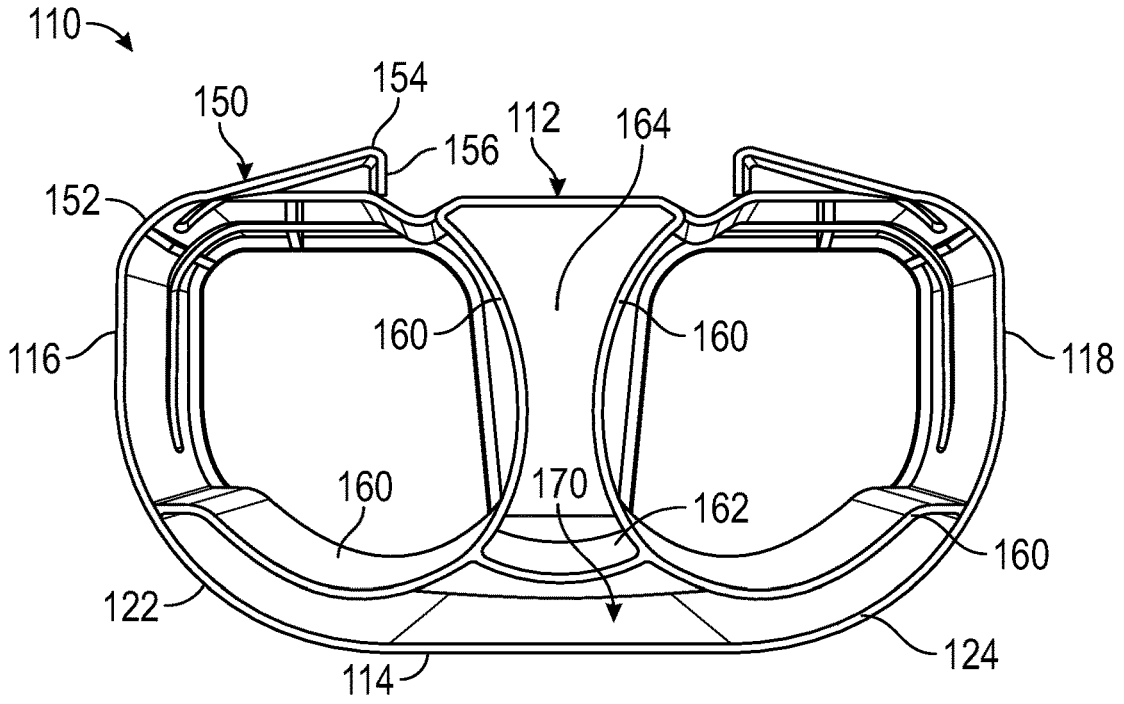
FIG. 7 is another front perspective view of the embodiment shown in FIG. 5.
Figure 8:
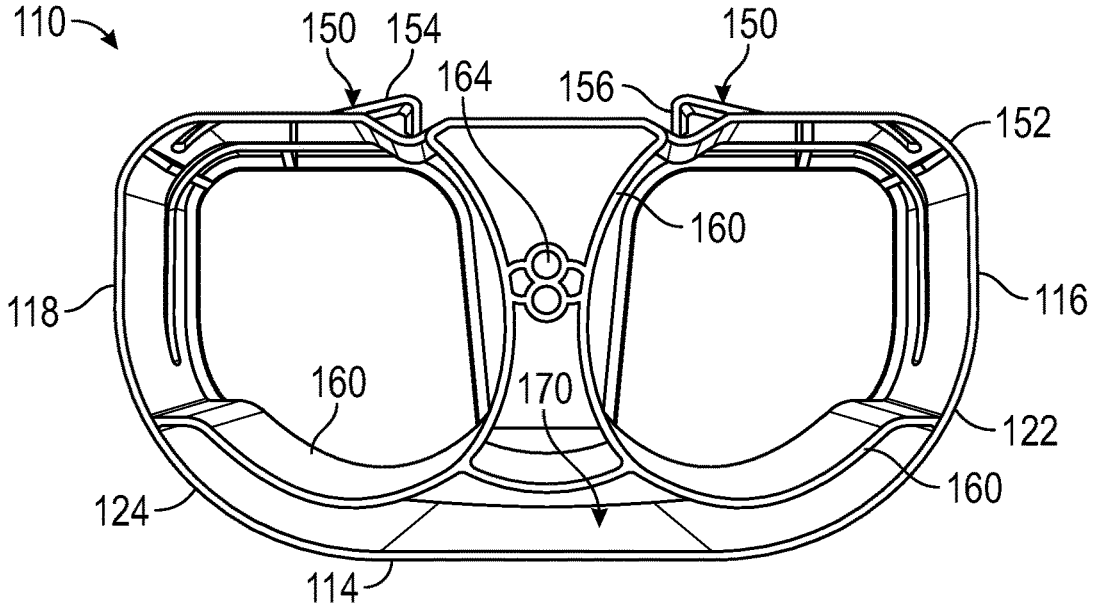
FIG. 8 is a back perspective view of the embodiment shown in FIG. 5.

As best seen in FIGS. 7-8, the bottom face 114 and bottom portions of the internal walls 160 define an opening 170. The opening 170 extends in a generally planar direction from a plane defined by the bottom face 114.

Figure 9A:
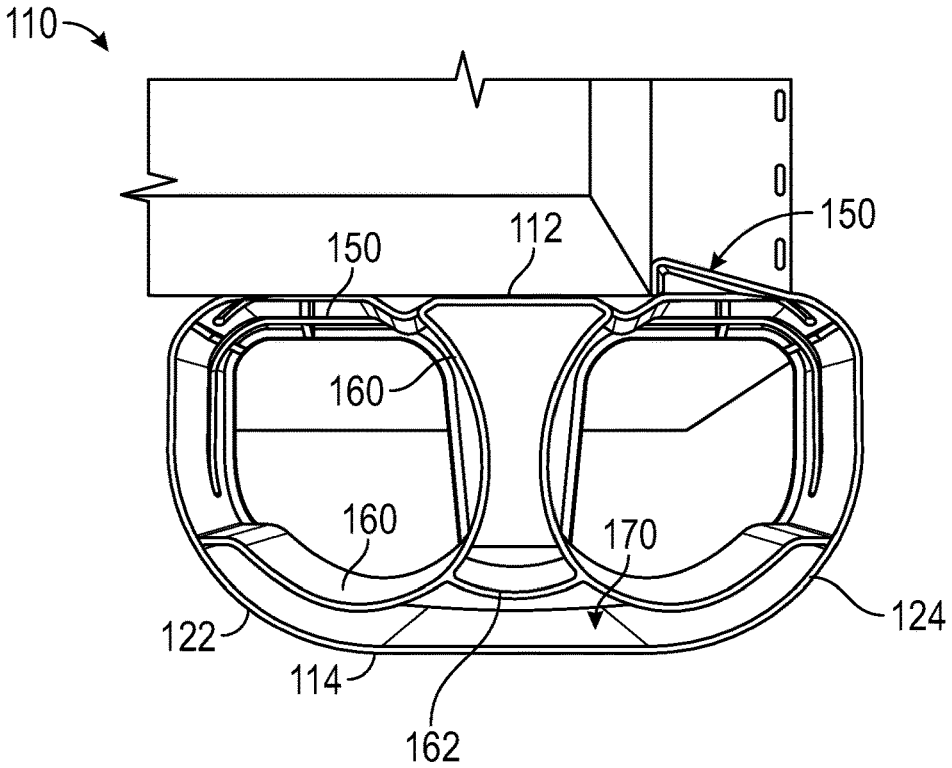
FIG. 9A is a front perspective view of the embodiment shown in FIG. 5, securing a window when not under any stresses.
Figure 9B:
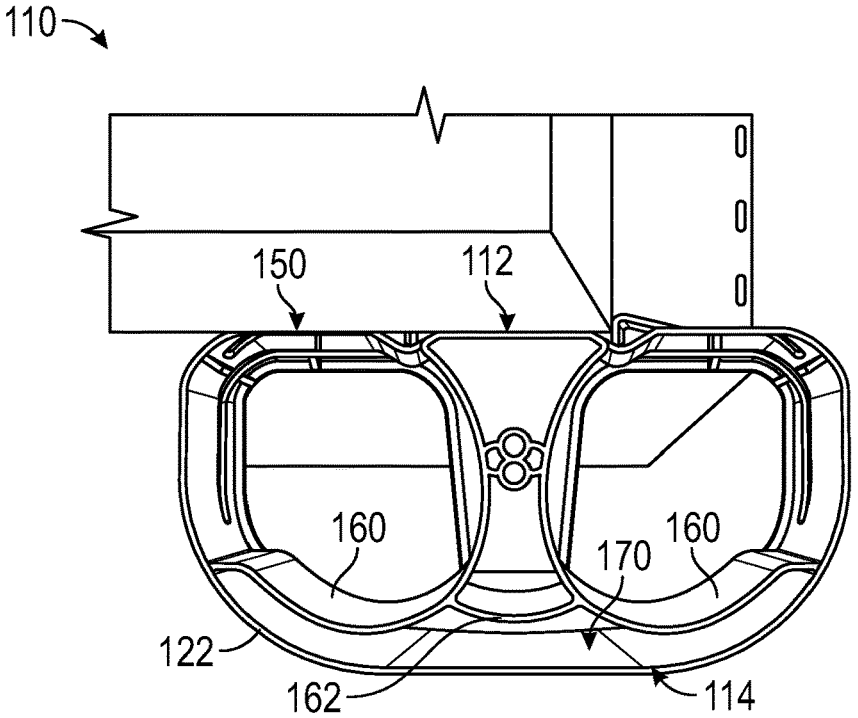
FIG. 9B is a front perspective view of the embodiment shown in FIG. 5, securing a window when under stress.

Referring now to FIG. 9A along with FIGS. 7-8, a front perspective view of the block 110 secured to a window is shown, where the block 110 is not under any stress. FIG. 9B is a front perspective view of the block 100 when stress is applied to the block 110. The opening 170 is in a compressed state, as the bottom portions of the internal walls 160 and the bottom face 114 are forced in a direction toward each other, thus absorbing the stress/pressure put on the block 110.

As shown in FIGS. 9A and 9B, the block 110 provides protection from shock loading by having a type of flexible suspension that allows the bottom face 114 of the block to deform toward the internal walls 160, as a load is applied (bouncing or dropping the window). The suspension of the window within the block dissipate the stress forces, protecting the window by cushioning or dampening the impact stresses/loads.

Referring now to FIGS. 10-18, other embodiments of shipping blocks are shown that have certain similar features as the block 110. For ease of explanation, where the blocks have the same features as the embodiment shown in FIGS. 5-9, the same numbering of elements will be used.

Figure 10:
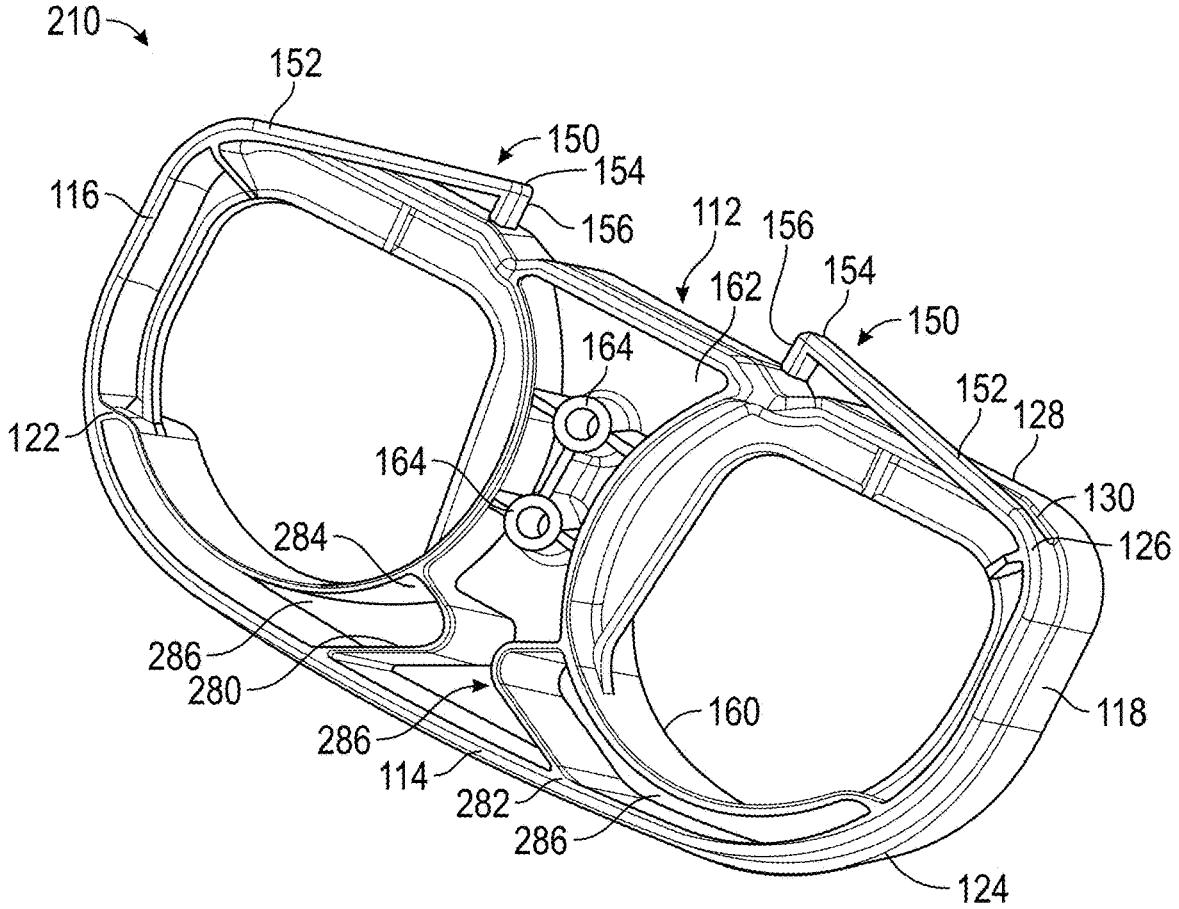
FIG. 10 is a front perspective view of another embodiment of a shipping block.

FIG. 10 shows a shipping block 210 that includes one or more internal spring walls 280. In the embodiment shown, there are opposing internal spring wall 280 that have the same configuration; for ease of explanation, the same numbers will be used to describe the opposing internal spring walls 280. It is also to be understood that the internal spring wall 280 can have different configurations, such as a leaf spring-type configuration. Each internal spring wall 280 has a first end 282 which extends from the bottom face 116 at an acute angle from a plane defined by bottom face 114. Each internal spring wall 280 terminates at a second end 284 at a point on a lower section of the internal wall 160. The internal spring walls 280 define one or more openings 286 which provide additional suspension and flex to the block 210.

Figure 11:
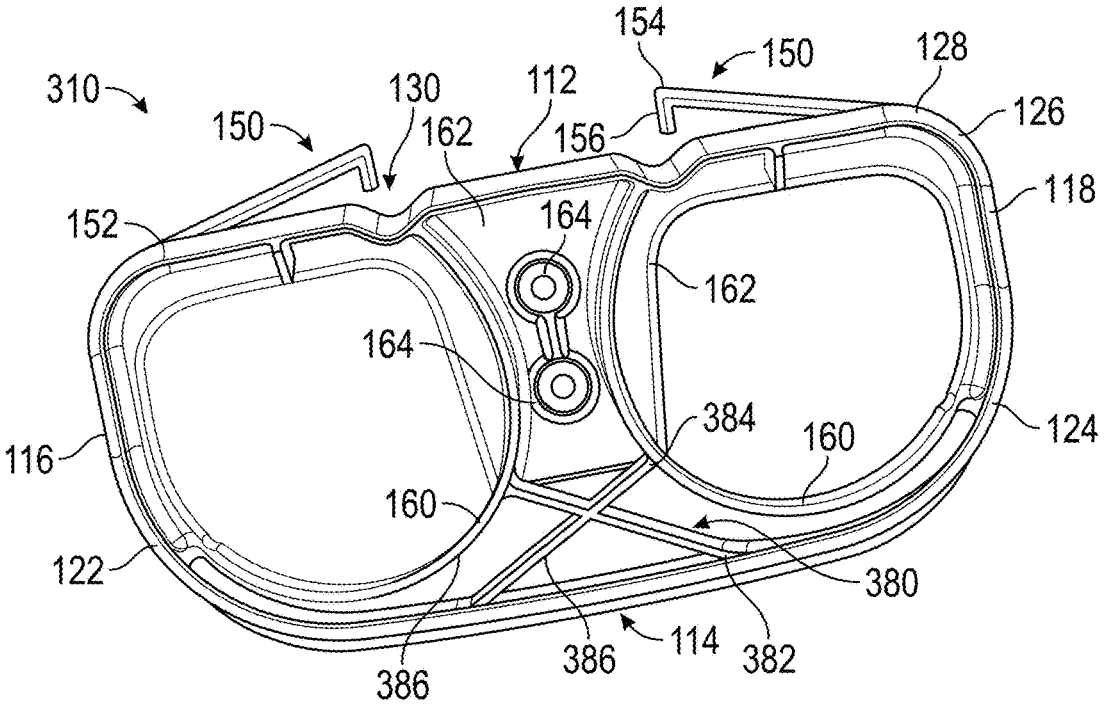
FIG. 11 is a front perspective view of another embodiment of a shipping block.

FIG. 11 shows a shipping block 310 that includes opposing internal cross walls 380. As each internal cross wall 380 has the same configuration, for ease of explanation, the same numbers will be used to describe the opposing internal cross walls 380. Each internal cross wall 380 has a first end 382 which extends from the bottom face 116 at an acute angle from a plane defined by bottom face 114. Each internal cross wall 380 terminates at a second end 384 at a point on a lower section of the internal wall 160. The internal cross walls 380 define one or more openings 386 which provide additional suspension and flex to the block 310.

Figure 12:
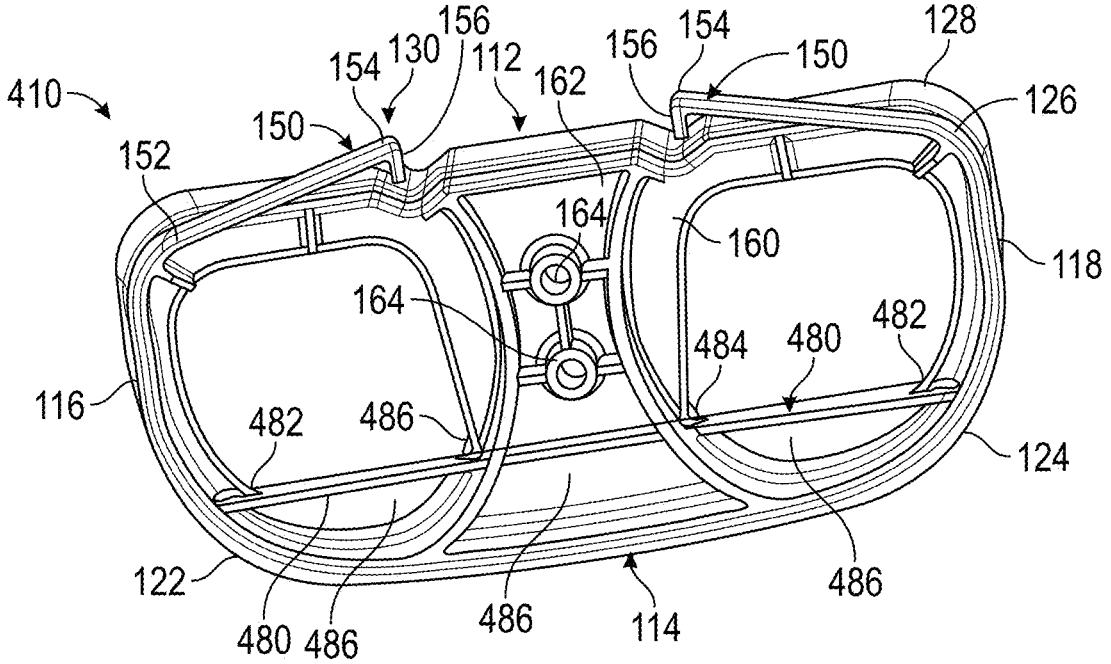
FIG. 12 is a front perspective view of another embodiment of a shipping block.

FIG. 12 shows a shipping block 410 that includes opposing internal laterally-extending walls 480. As each internal laterally-extending wall 480 has the same configuration, for ease of explanation, the same numbers will be used to describe the opposing internal laterally-extending walls 480. Each internal laterally-extending wall 480 has a first end 480 which extends from the end face 116 (or end face 118) in a generally planar direction, as defined by bottom face 114. Each internal laterally-extending wall 480 terminates at a second end 484 at a point on a center internal wall 162. The internal laterally-extending walls 480 define one or more openings 486 which provide additional suspension and flex to the block 410.

Figure 13:
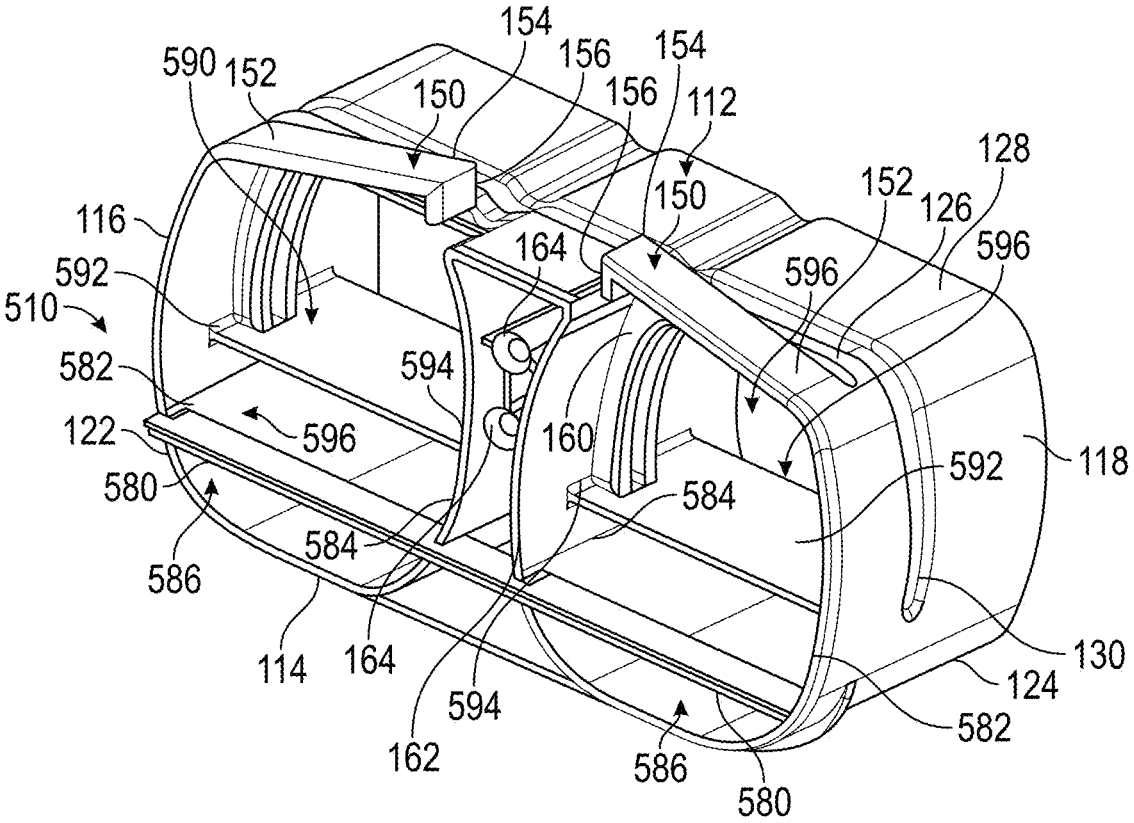
FIG. 13 is a front perspective view of another embodiment of a shipping block.

FIG. 13 shows a shipping block 510 that includes opposing internal laterally-extending walls 580. As each internal laterally-extending wall 580 has the same configuration, for ease of explanation, the same numbers will be used to describe the opposing internal laterally-extending walls 580. Each internal laterally-extending wall 580 has a first end 582 which extends from the end face 116 (or end face 118) in a generally planar direction, as defined by bottom face 114. Each internal laterally-extending wall 580 terminates at a second end 584 at a point on a center internal wall 162. The internal laterally-extending walls 580 define one or more openings 586 which provide additional suspension and flex to the block 510.

FIG. 13 further includes opposing internal bracing walls 590. As each internal bracing wall 590 has the same configuration, for ease of explanation, the same numbers will be used to describe the opposing internal bracing walls 590. Each internal bracing wall 590 has a first end 592 which extends from the end face 116 (or end face 118) in a generally planar direction, as defined by bottom face 114. Each internal bracing wall 590 terminates at a second end 594 at a point on the internal wall 162. The internal bracing walls 590 define one or more openings 596 which provide additional structural support to the block 510.

Figure 14:
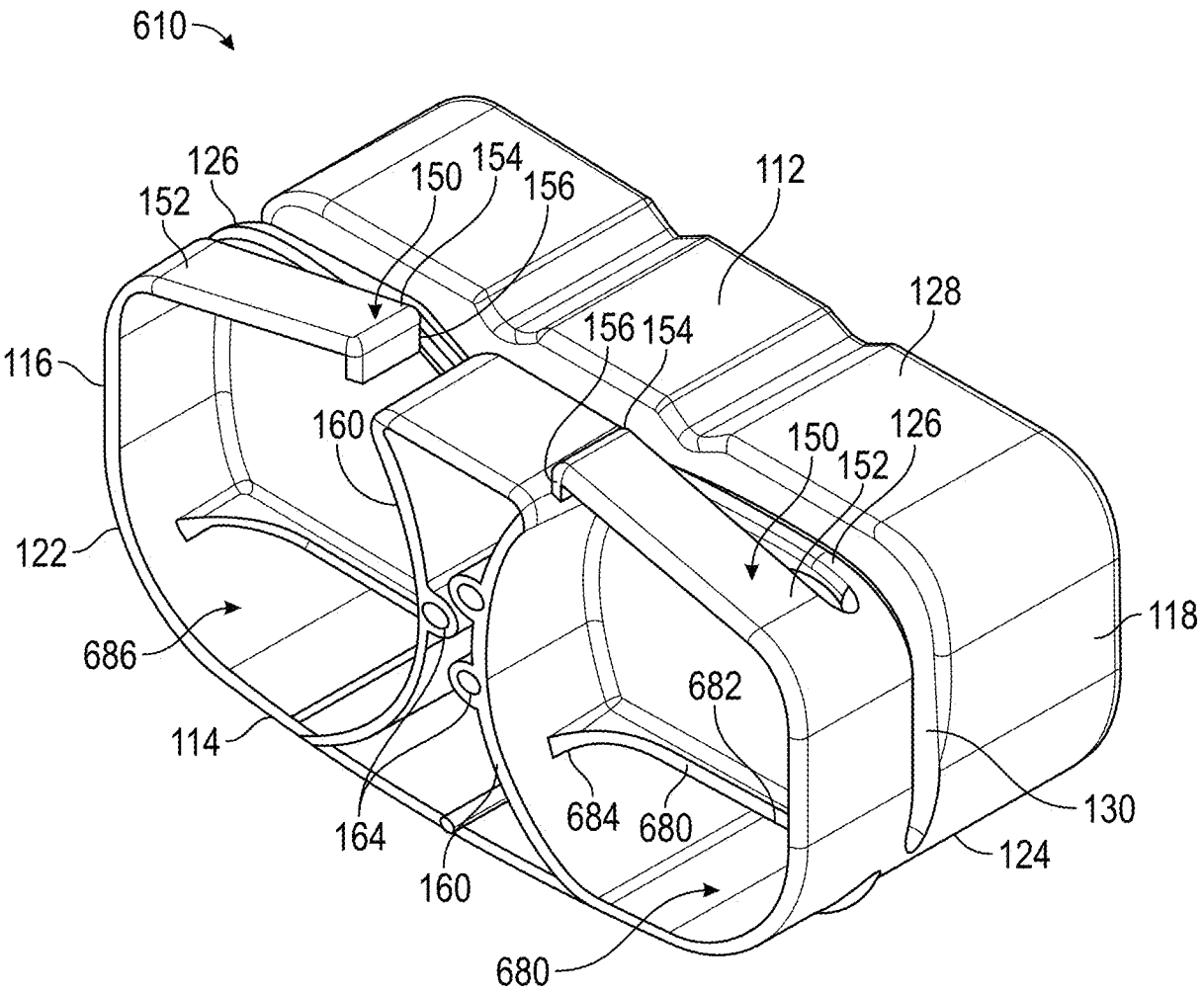
FIG. 14 is a front perspective view of another embodiment of a shipping block.

FIG. 14 shows a shipping block 610 that includes opposing internal laterally-extending walls 680. As each internal laterally-extending wall 680 has the same configuration, for ease of explanation, the same numbers will be used to describe the opposing internal laterally-extending walls 680. Each internal laterally-extending wall 680 has a first end 682 which extends from the end face 116 (or end face 118) in a generally planar direction, as defined by bottom face 114. Each internal laterally-extending wall 680 terminates at a second end 684 at a point on the internal wall 162. The internal laterally-extending walls 680 define one or more openings 686 which provide additional suspension and flex to the block 610.

Figure 15A:
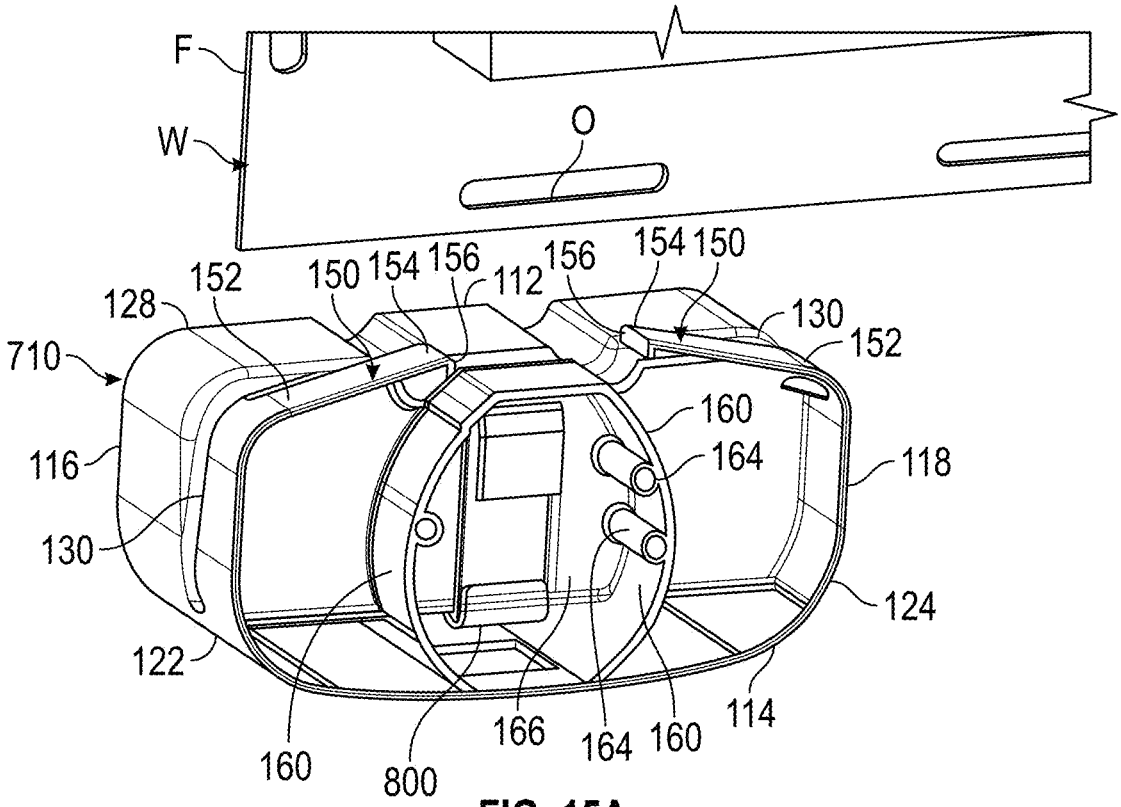
FIG. 15A is a perspective view of another embodiment of a shipping block before securing a window.
Figure 15B:
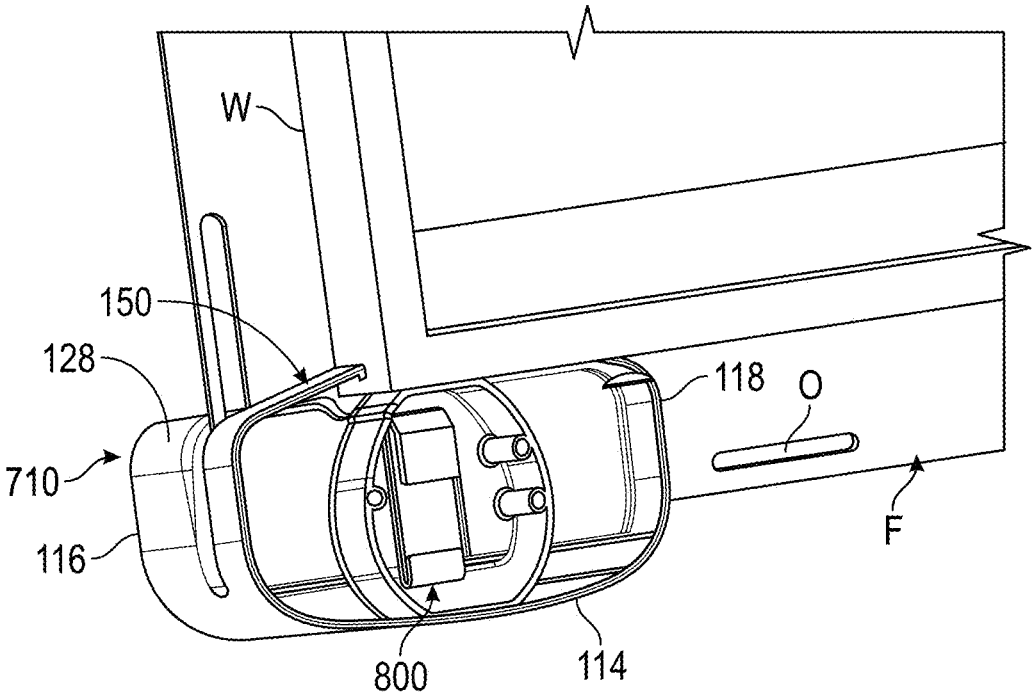
FIG. 15B is a perspective view of another embodiment of a shipping block after securing a window.

FIG. 15A shows a shipping block 710 adjacent a window W having a nail fin F and an opening O in the nail fin F. The shipping block 710 includes opposing internal walls 160. In the embodiment shown, as each internal wall 160 has the same configuration, for ease of explanation, the same numbers will be used to describe the opposing internal walls 160. Each internal wall 160 extends from the top face 112 to the bottom face 114. The internal walls 160 have an arcuate shape that, when pressure is applied to the bottom face 114 or the top face 112, the shipping block 710 is able to flex. The internal walls 160 have a shape that deforms to cushion impact and vibrations to protect the product.

Figure 16A:
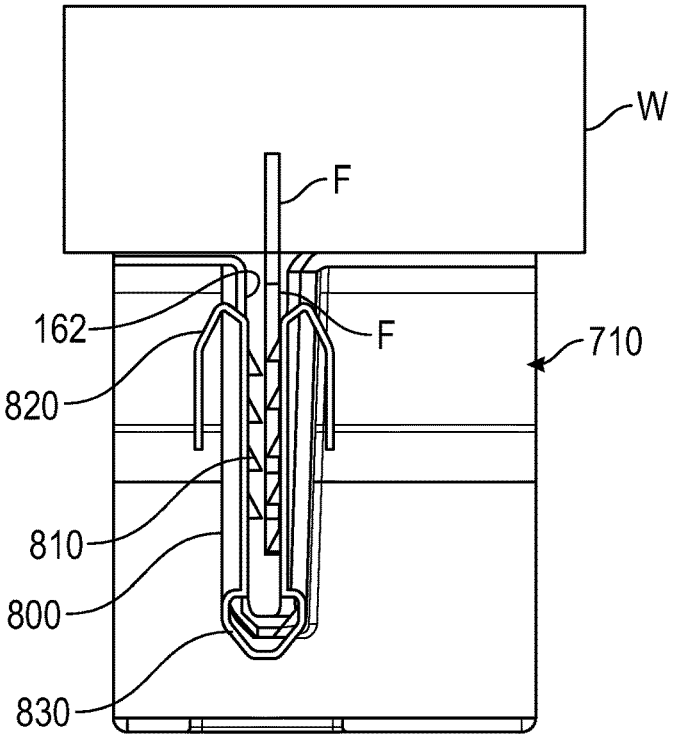
FIG. 16A shows a cross-sectional view, partially broken away, of a clip retention for holding a window in a shipping block.
Figure 16B:
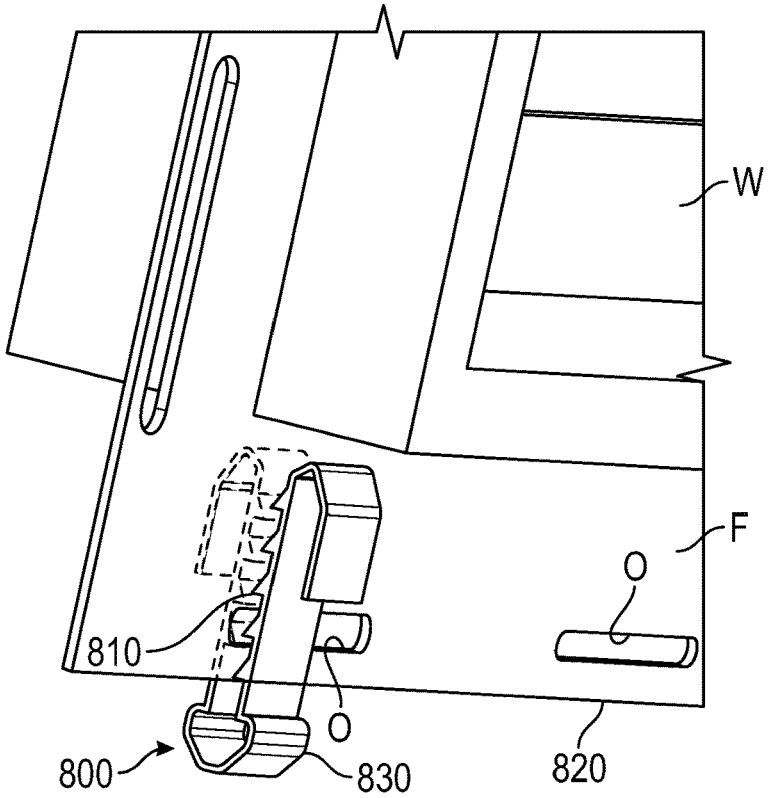
FIG. 16B shows a cross-sectional view, partially broken away, of the clip retention shown in FIG. 16A, holding a window in the shipping block.

The internal walls 160 define a middle portion 166 which is configured to receive a clip 800. In certain embodiments, the clip 800 can be a metal spring clip that has teeth 810 (as seen in FIGS. 16A-16B) that are configured to be removably secured to the nail fin F of the window W. Also, in certain embodiments, at least several teeth 810 on the clip 800 can be secured within the opening O in the nail fin F.

The clip 800 ramp-shaped opposing members 820 that are configured to guide the clip 800 onto the nail fin F. When the window nail fin F is pressed down into the shipping block, the clip 800 engages the nail fin F, thus holding the shipping block securely onto the window for shipping. Also, in certain embodiments, the clip 800 can have one or more tapered leading edges 830 to aid in guiding the clip 800 into the middle portion 166.

Figure 17A:
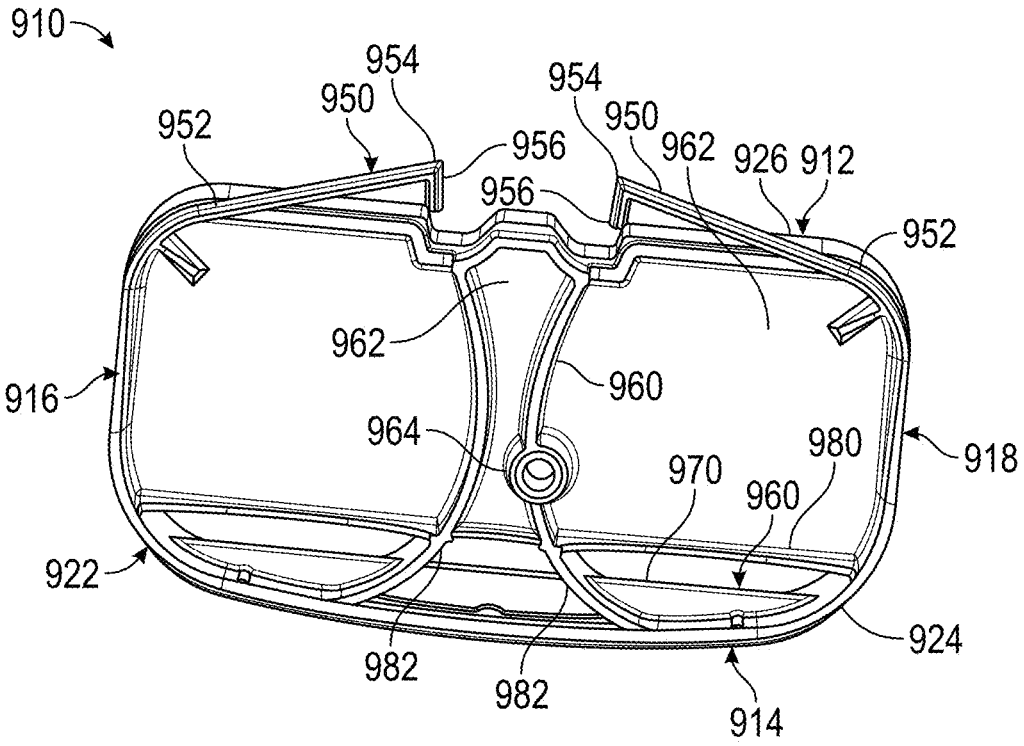
FIG. 17A is a front perspective view of another embodiment of a shipping block.
Figure 17B:
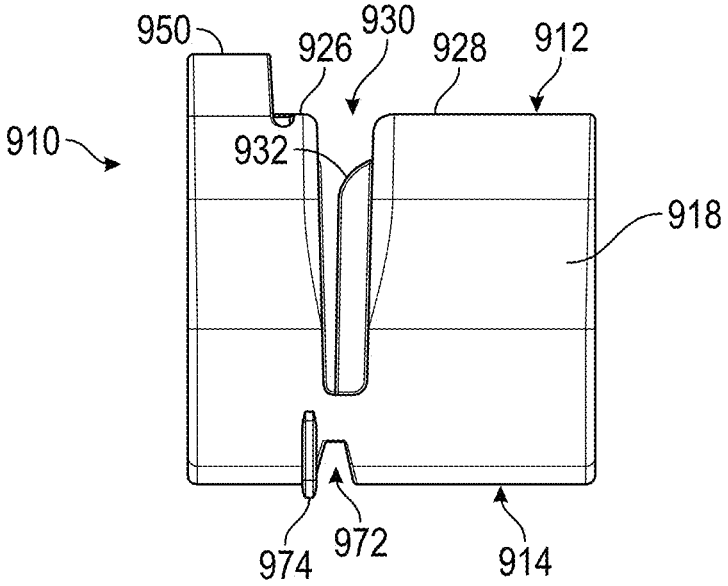
FIG. 17B is a side elevational view of the embodiment shown in FIG. 17A.

Referring now to FIGS. 17A-17B, another embodiment of a shipping block 910 is shown. The shipping block 910 generally has a top face 912, a bottom face 914, a first end face 916, and a second end face 918.

The bottom face 914 and the first end face 916 meet at a first leading edge chamfer 922, which provides a sloping surface such that a transitional slope is defined between the first end face 916 and the bottom face 914. Similarly, the bottom face 914 and the second end face 918 meet at an opposing, second leading edge chamfer 924, which also provides a sloping surface such that a transitional slope is defined between the second end face 918 and the bottom face 914. The leading edge chamfers 922, 924 of the block 910 allow the block to slide across dock plates, ramps, gravel, parking lots to provide easy and safe delivery of the product to the job site.

The top face 912 defines first and second extending portions 926 and 928 are in a spaced apart relationship with each other. The first and second extending portions 926, 928 extend from the first end face 916 to the second end face 918.

The first and second extending portions 926, 928 are configured to receive tape portions (not shown). It is to be understood, however, that the block 910 can also receive tape portions that are two-sided such that the bottoms of the tape portions adhere to the extending portions 926, 928, while the tops of the tape portions adhere to a flat-panel being held within the block 910.

The first and second extending portions define a receiving slot 930. The receiving slot 930 extends from the first end face 116 to the second end face 918.

The receiving slot 930 can have any desired shape to securely hold the flat-panel product. The receiving slot 930 includes a plurality of thin flexible protrusions 932 which are spaced along walls of the slot 930. The protrusions 932 help align and hold the shipping block 910 as the block 910 is placed on a window as the protrusion 932 temporarily engage the window nailing fin. The protrusions 932 also create a good pressure contact fit until the block 910 is removably screwed onto the window.

The flexibility of the protrusions 932 allows for the block 910 to be used on various thicknesses of the bottom window corners. The flexible protrusions 932 allows the block 910 to securely stay on the window until the screw is put into the block and window.

The top face 912 of the shipping block 910 also defines opposing first and second alignment tabs 950. As each alignment tab 950 has the same configuration, for ease of explanation, the same numbers will be used to describe the opposing alignment tabs 950. Each alignment tab 950 has a first tab end 952 which extends from the end faces 916, 918 at an acute angle from a plane defined by top face 912. Each alignment tab 950 terminates at a second tab end 954, which has a downwardly-extending tab portion 956.

The alignment tabs 950 allow the correct placement of the block 910 with respect to either side of the product. For example, when the product is a window, the alignment tabs 950 protect window's nail fin and stucco flanges from being damaged from the sides of the window hitting or running into other object.

The alignment tabs 950 operate independently, such that the block can be used on any corner or along the sides of the window. In use, the alignment tabs 950 individually push down flush to the top face 912 of the block 910 such that the block can be used on either left or right corners, and also can be used in the center, of the window. The opposing alignment tabs 950 are also beneficial, as only type of block may be needed for many window packaging requirements.

The shipping block 910 further includes opposing internal walls 960. In the embodiment shown, as each internal wall 960 has the same configuration, for ease of explanation, the same numbers will be used to describe the opposing internal walls 960. Each internal wall 960 at least partially extend from the top face 912 to the first or second end faces 916 and 918 at a point that is adjacent to the bottom face 914.

In certain embodiments, one or more supporting extending walls 962 extend from the internal walls 960 to provide support to the block 910. In certain embodiments, the supporting extending walls 962 can further define one or more bosses/openings 964 which allow a temporary screw to secure the shipping block to a flat-panel being protected. This provides an added benefit since multiple window frame profile utilize different attachment points. Such attachment point must be below installation hole provided by the window manufacturer on the fin. This prevents additional work during the installation process to prevent water leakage.

In the embodiment shown in FIG. 17A, the bottom face 914 and bottom portions of the internal walls 960 define an opening 970. The opening 970 extends in a generally planar direction from a plane defined by the bottom face 914. When the opening 970 is in a compressed state, as the bottom portions of the internal walls 960 and the bottom face 914 are forced in a direction toward each other, thus absorbing the stress/pressure put on the block 910.

The block 910 provides protection from shock loading by having a type of flexible suspension that allows the bottom face 914 of the block to deform toward the internal walls 960, as a load is applied (bouncing or dropping the window). The suspension of the window within the block dissipate the stress forces, protecting the window by cushioning or dampening the impact stresses/loads.

The bottom face 914 of the block 910 further includes a groove 972 and a ridge 974 which allows windows to be vertically double stacked and securely held in place during shipping.

The shipping block 910 includes opposing internal cross walls 980. As each internal cross wall 980 has the same configuration, for ease of explanation, the same numbers will be used to describe the opposing internal cross walls 980. Each internal cross wall 980 has a first end 982 which extends from the bottom face 916 at an acute angle from a plane defined by bottom face 914. Each internal cross wall 980 terminates at a second end 984 at a point on a lower section of the internal wall 960.

Figure 18A:
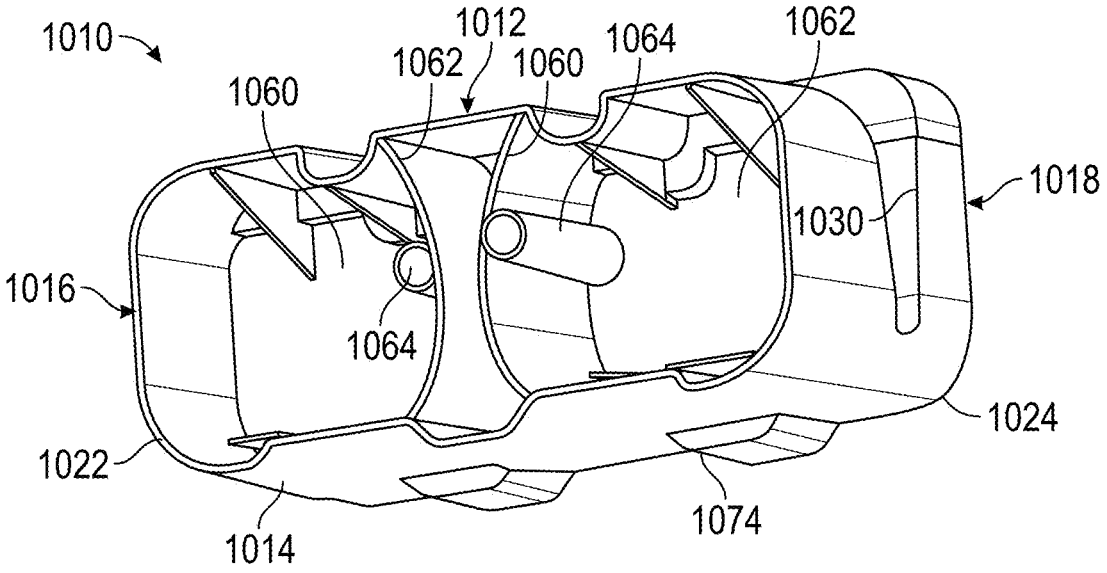
FIG. 18A is a front perspective view of another embodiment of a shipping block.
Figure 18B:
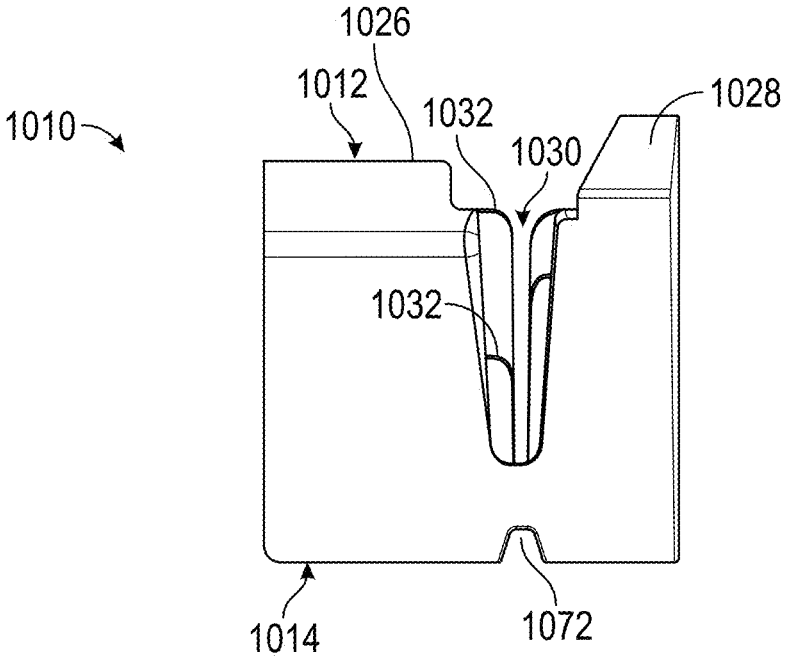
FIG. 18B is a side elevational view of the embodiment shown in FIG. 18A.
Figure 18C:
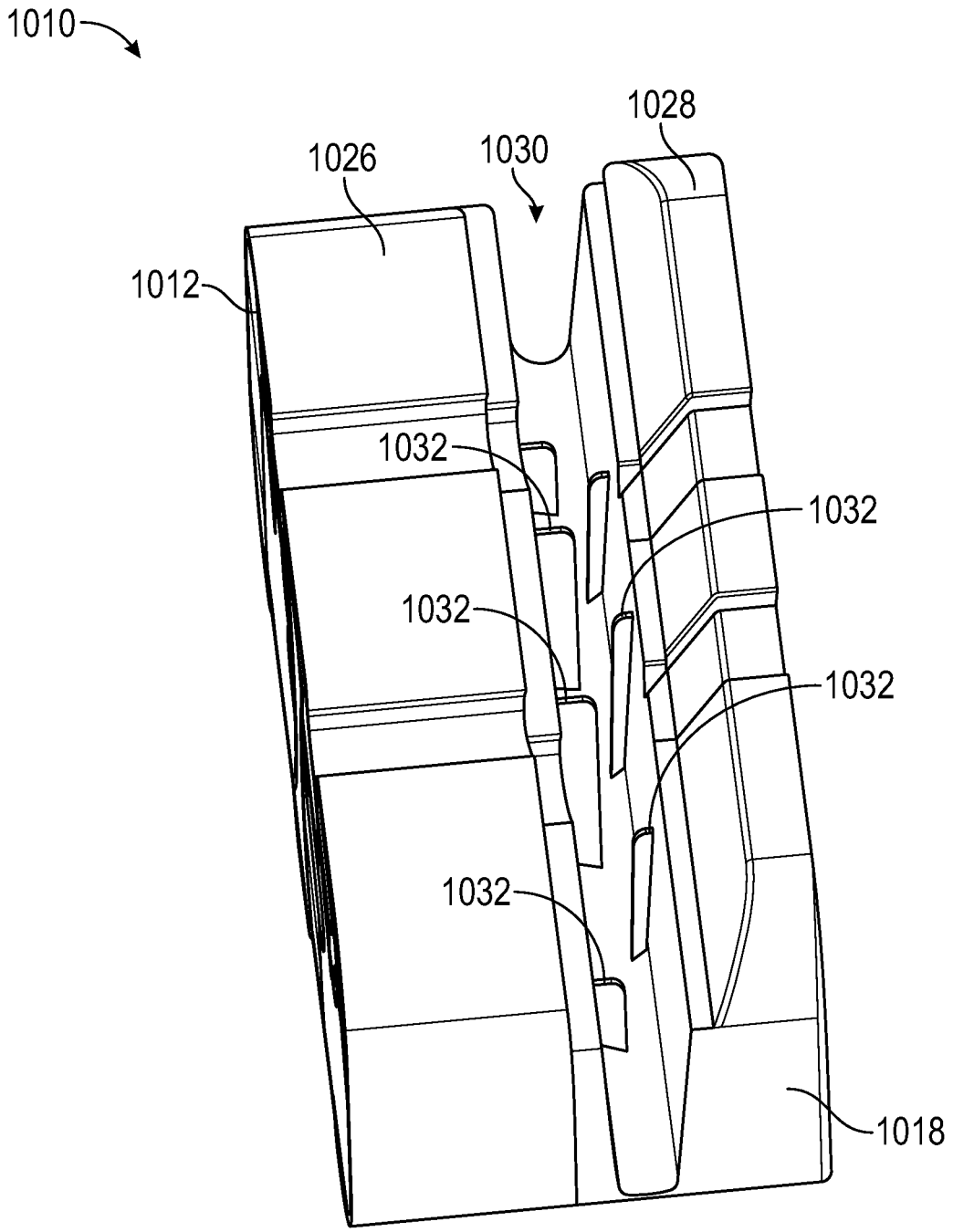
FIG. 18C is a top perspective view of the embodiment shown in FIG. 18A.

Referring now to FIGS. 18A-18C, another embodiment of a shipping block 1010 is shown. The shipping block 1010 generally has a top face 1012, a bottom face 1014, a first end face 1016, and a second end face 1018.

The bottom face 1014 and the first end face 1016 meet at a first leading edge chamfer 1022, which provides a sloping surface such that a transitional slope is defined between the first end face 1016 and the bottom face 1014. Similarly, the bottom face 1014 and the second end face 1018 meet at an opposing, second leading edge chamfer 1024, which also provides a sloping surface such that a transitional slope is defined between the second end face 1018 and the bottom face 1014. The leading edge chamfers 1022, 1024 of the block 1010 allow the block to slide across dock plates, ramps, gravel, parking lots to provide easy and safe delivery of the product to the job site.

The top face 1012 defines first and second extending portions 1026 and 1028 are in a spaced apart relationship with each other. The first and second extending portions 1026, 1028 extend from the first end face 1016 to the second end face 1018.

The first and second extending portions 1026, 1028 are configured to receive tape portions (not shown). It is to be understood, however, that the block 1010 can also receive tape portions that are two-sided such that the bottoms of the tape portions adhere to the extending portions 1026, 1028, while the tops of the tape portions adhere to a flat-panel being held within the block 1010.

The first and second extending portions define a receiving slot 1030. The receiving slot 1030 extends from the first end face 1016 to the second end face 1018. The receiving slot 1030 can have any desired shape to securely hold the flat-panel product. The receiving slot 1030 includes a plurality of thin flexible protrusions 1032 which are spaced along walls of the slot 1030. The protrusions 1032 help align and hold the shipping block 1010 as the block 1010 is placed on a window as the protrusion 1032 temporarily engage the window nailing fin. The protrusions 1032 also create a good pressure contact fit until the block 1010 is removably screwed onto the window.

The flexibility of the protrusions 1032 allows for the block 1010 to be used on various thicknesses of the bottom window corners. The flexible protrusions 1032 allows the block 1010 to securely stay on the window until the screw is put into the block and window.

The shipping block 1010 further includes opposing internal walls 1060. In the embodiment shown, as each internal wall 1060 has the same configuration, for ease of explanation, the same numbers will be used to describe the opposing internal walls 1060. Each internal wall 1060 at least partially extend from the top face 1012 to the first or second end faces 1016 and 1018 at a point that is adjacent to the bottom face 1014.

In certain embodiments, one or more supporting extending walls 1062 extend from the internal walls 1060 to provide support to the block 1010. In certain embodiments, the supporting extending walls 1062 can further define one or more bosses/openings 1064 which allow a temporary screw to secure the shipping block to a flat-panel being protected. This provides an added benefit since multiple window frame profile utilize different attachment points. Such attachment point must be below installation hole provided by the window manufacturer on the fin. This prevents additional work during the installation process to prevent water leakage.

The block 1010 provides protection from shock loading by having a type of flexible suspension that allows the bottom face 1014 of the block to deform toward the internal walls 1060, as a load is applied (bouncing or dropping the window). The suspension of the window within the block dissipate the stress forces, protecting the window by cushioning or dampening the impact stresses/loads.

In the embodiment shown in FIG. 18A, the bottom face 1014 of the block 1010 further includes a ridge 1074 which allows windows to be vertically double stacked and securely held in place during shipping.

In the embodiment shown in FIG. 18B, the bottom face 1014 of the block 1010 further includes a groove 1072 which allows windows to be vertically double stacked and securely held in place during shipping.

Exemplary Uses and Advantages of Blocks

Referring now to each block embodiment, the block meets all of the critical performance requirements for properly protecting the flat-panel products, and in particular, windows. The block keeps the products off the ground. For example, the block is configured such that the corners, the nail fin, and flanges (which are the weakest parts) of the window are protected against bending or breakage during shipping and handling.

The block is flexible for shock loading when the product is dropped or riding in the back of a trailer bouncing around. The block protects the product from external forces and stresses that are put on the block. In particular, the block protects the glass inside the frame of window product.

In use, the one or more blocks can be placed at the corners and at the center of large products. Other blocks can be placed on one side of the product, allowing the product to be shipped using less trailer floor space.

In certain embodiments, different blocks can have different configurations such that certain blocks are used for one corner and another type of block that fit the other corner. In still other embodiments, the block can be configured to be placed at the bottom or sides of the product. Also, the block is reusable after being removed from the shipped product.

The block is made of a suitable plastic and flexible material such that, if the product gets wet, the block still perform well, and does not deteriorates as it gets wet. In certain embodiments, the block is generally made using a plastic injection molded process. Another benefit to such plastic molding process is that the block can have a large radius on the leading and trailing chamfered edges that allow the product to be easily slid across dock plates, ramps, gravel and any other surface that would normal catch other current shipping blocks.

Testing of Blocks

Figure 19A:
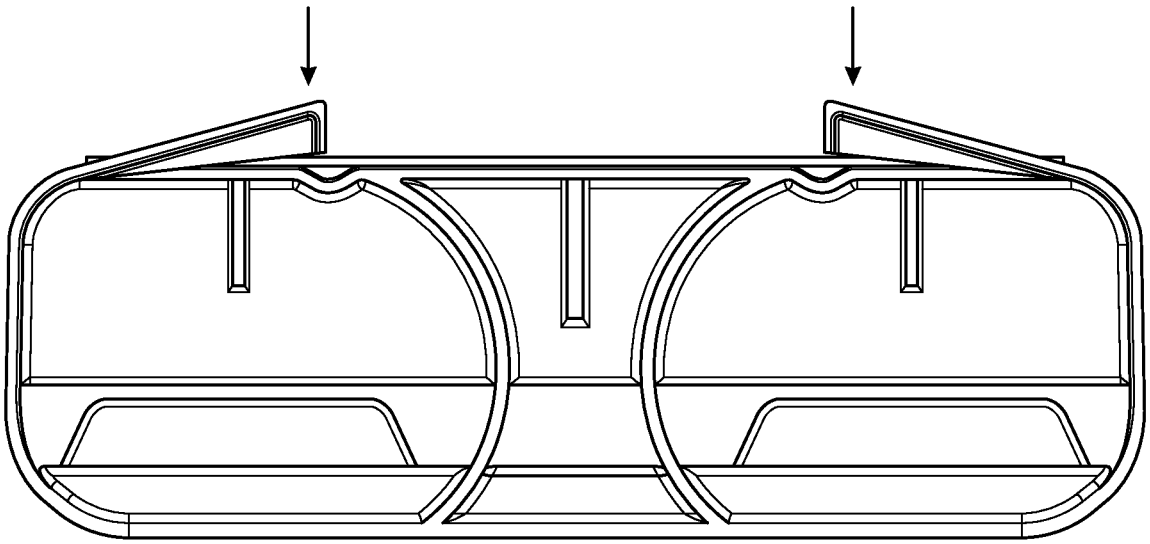
FIGS. 19A-19B are a schematic illustration of a shipping block under a vertical loading test.
Figure 19B:
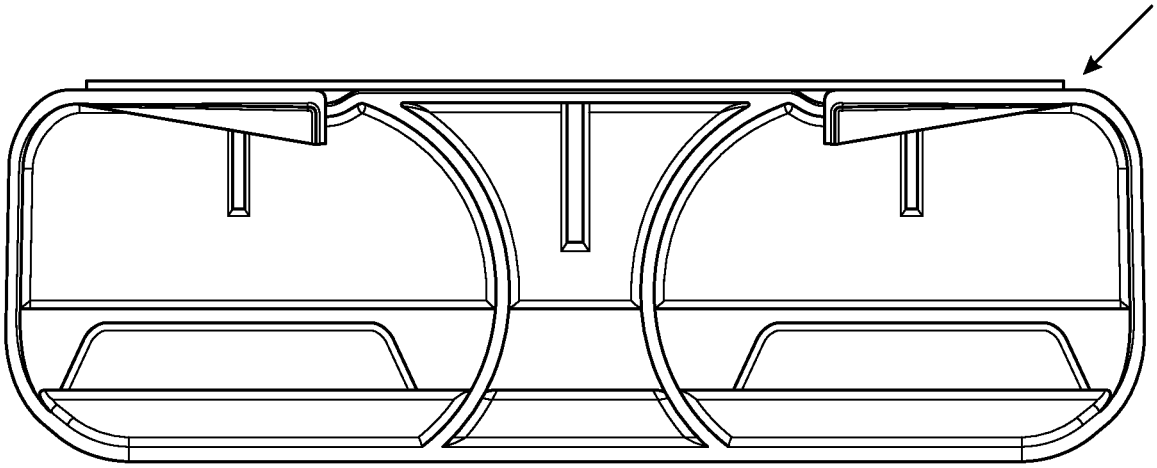

Referring now to FIGS. 19A-19B, there is shown a schematic illustration of a vertical alignment tab folding and retaining strength test. In this test, a vertical 4 lbs. force is applied to the alignment tabs in order to bend the alignment tabs below the top face of the block, as shown by the arrows in FIG. 19Ap. The shipping block passes the test if the alignment tabs are able to be flexed below the top face of the shipping block. The shipping block fails the test if more force is required to bend the alignment tabs below the top surface as shown by the arrows in FIG. 19B.

Figure 20A:
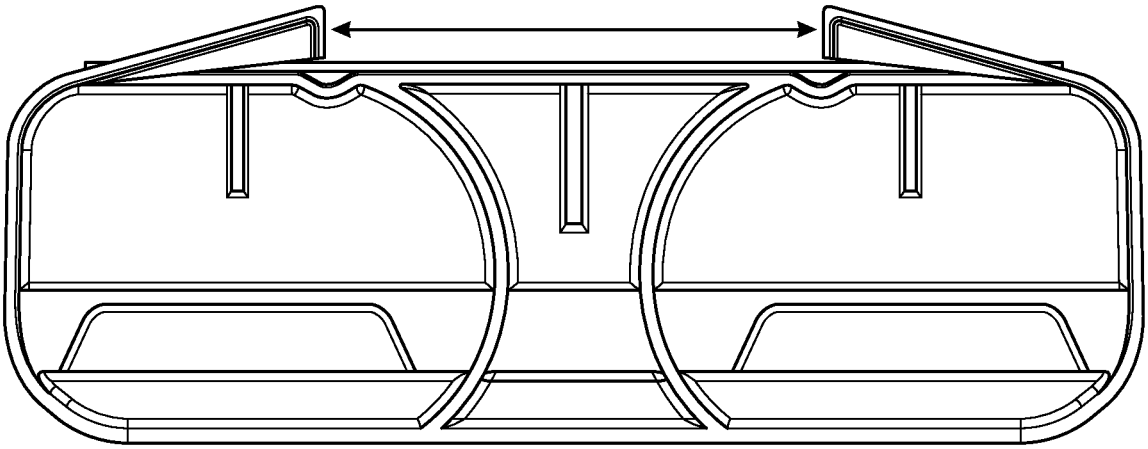
FIGS. 20A-20B are a schematic illustration of a shipping block under a horizontal loading test.
Figure 20B:
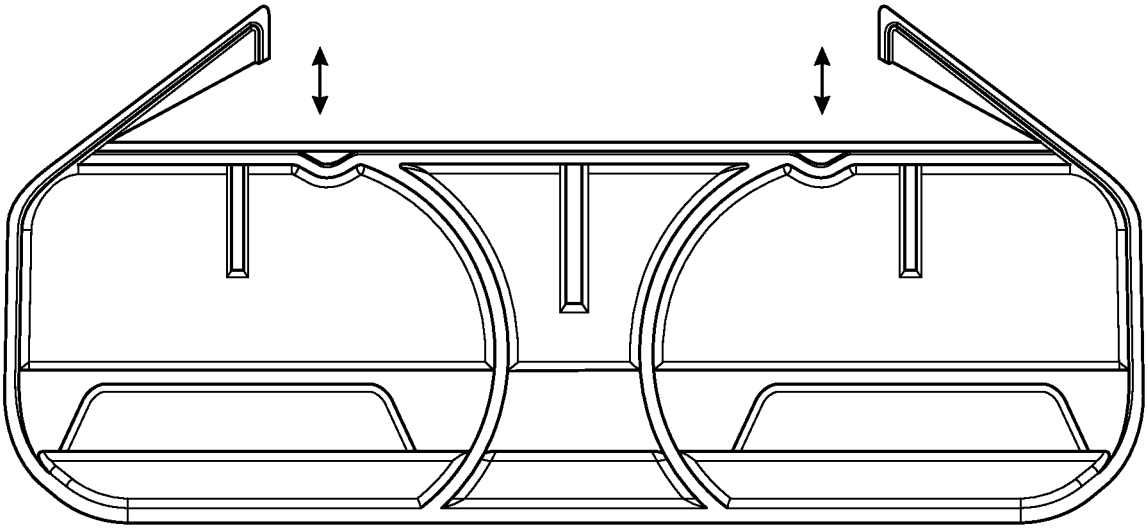

Referring now to FIGS. 20A-20B, there is shown a schematic illustration of a horizontal alignment tab folding and retaining strength test. In this test, a horizontal load 50 lbs. force is applied to the alignment tabs as shown by the arrows in FIG. 20A. The shipping block passes the test if the tabs do not bend or deflect upward over 0.50 inch from top face. The shipping block fails the test if the table deflect upward more than 0.50 inches as shown by the arrows in FIG. 20B.

Figure 21:
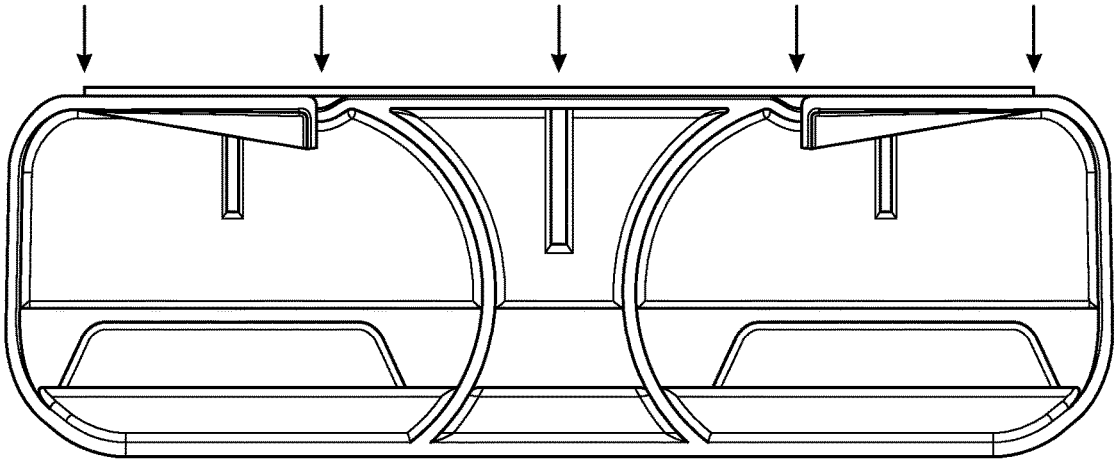
FIG. 21 is a schematic illustration of a shipping block under a static vertical loading test.

Referring now to FIG. 21, there is shown a schematic illustration of a vertical static strength test. In this test, a vertical load of 150 lbs. force is applied to the top of the block for 10 min without structure failing, as shown by the arrows in FIG. 21. The shipping block passes the test if the block deflects, but there is no crack or breakage of any walls. The shipping block fails the test if there are any cracks or breakage of any walls.

Figure 22:
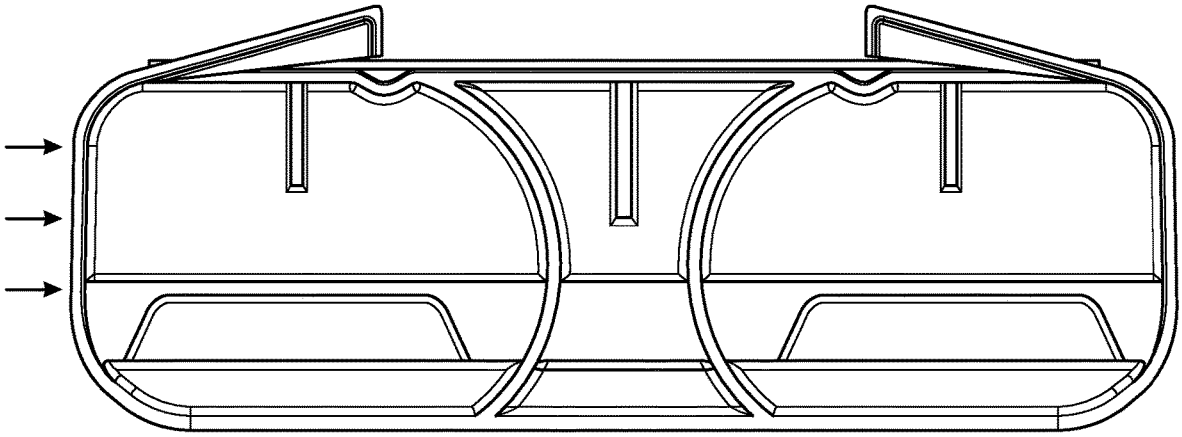
FIG. 22 is a schematic illustration of a shipping block under a static horizontal loading test.

Referring now to FIG. 22, there is shown a schematic illustration of a horizontal strength test. In this test, a horizontal load of 75 lbs. force is applied to the ends of the block for 10 min without structure failing, as shown by the top arrows in FIG. 22. The shipping block passes the test if the block deflects, but there is no crack or breakage of any walls. The shipping block fails the test if there are any cracks or breakage of any walls.

Figure 23:
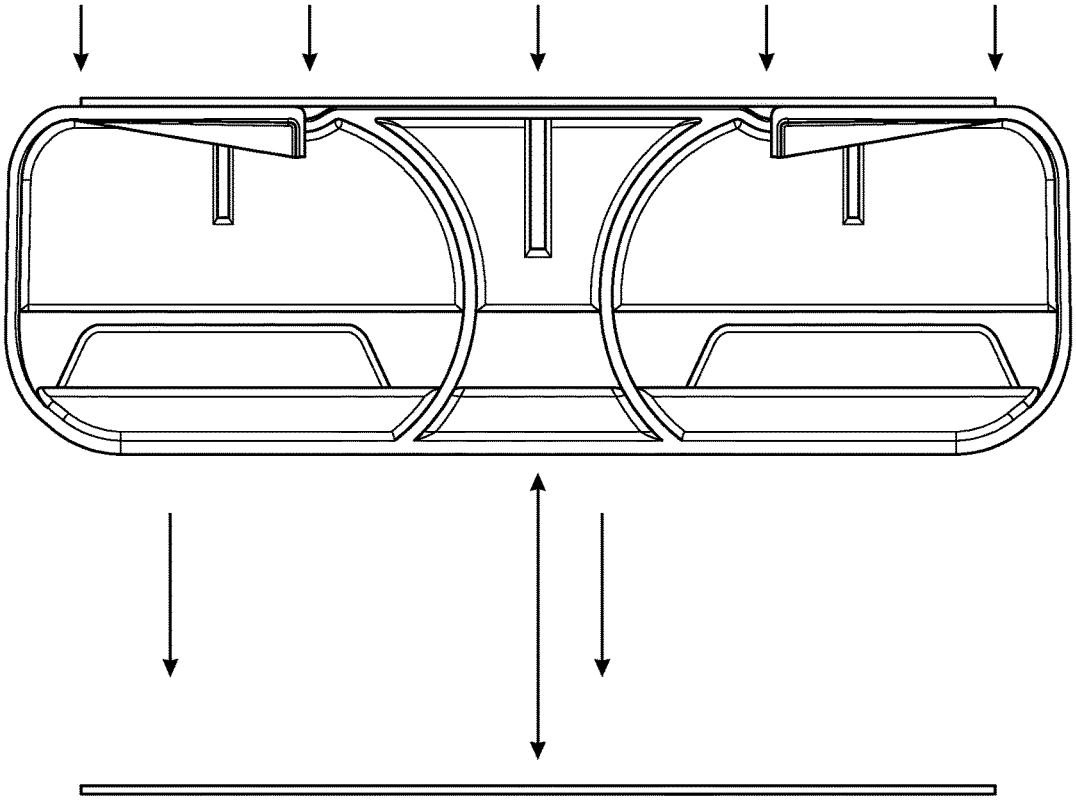
FIG. 23 is a schematic illustration of a shipping block under a straight drop test.

Referring now to FIG. 23, there is shown a schematic illustration of a vertical drop strength test, as shown by the top arrows in FIG. 23. In this test, a weight of 75 lbs. is applied to the block, and the block is vertically dropped from a height of 12 inches, as shown by the bottom arrows in FIG. 21. Then, the block is tested at different temperatures: 70° F., at 120° F., and at 0° F. The shipping block passes the test if the block deflects, but there is no crack or breakage of any walls. The shipping block fails the test if there are any cracks or breakage of any walls.

Figure 24:
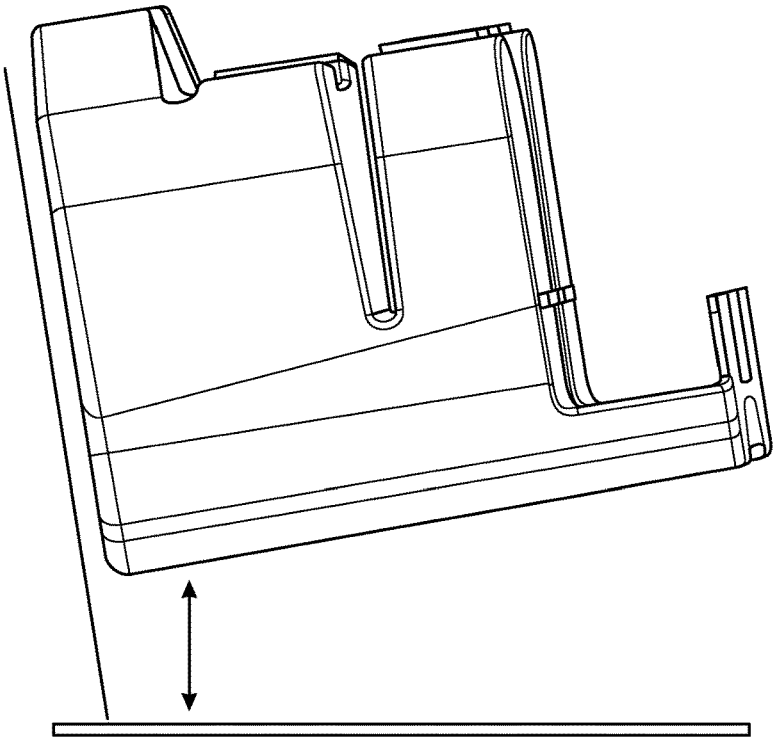
FIG. 24 is a schematic illustration of a shipping block under an edge angle drop test.

Referring now to FIG. 24, there is shown a schematic illustration of an edge drop strength test, as shown by the arrows in FIG. 24. In this test, a weight of 50 lbs. is applied to the block, and the block is vertically dropped from a height of 6 inches at an angle of 7-10 degrees. Then, the block is tested at different temperatures: 70° F., at 120° F., and at 0° F. The shipping block passes the test if block deflects, but there is no crack or breakage of any walls. The shipping block fails the test if there are any cracks or breakage of any walls.

Figure 25:
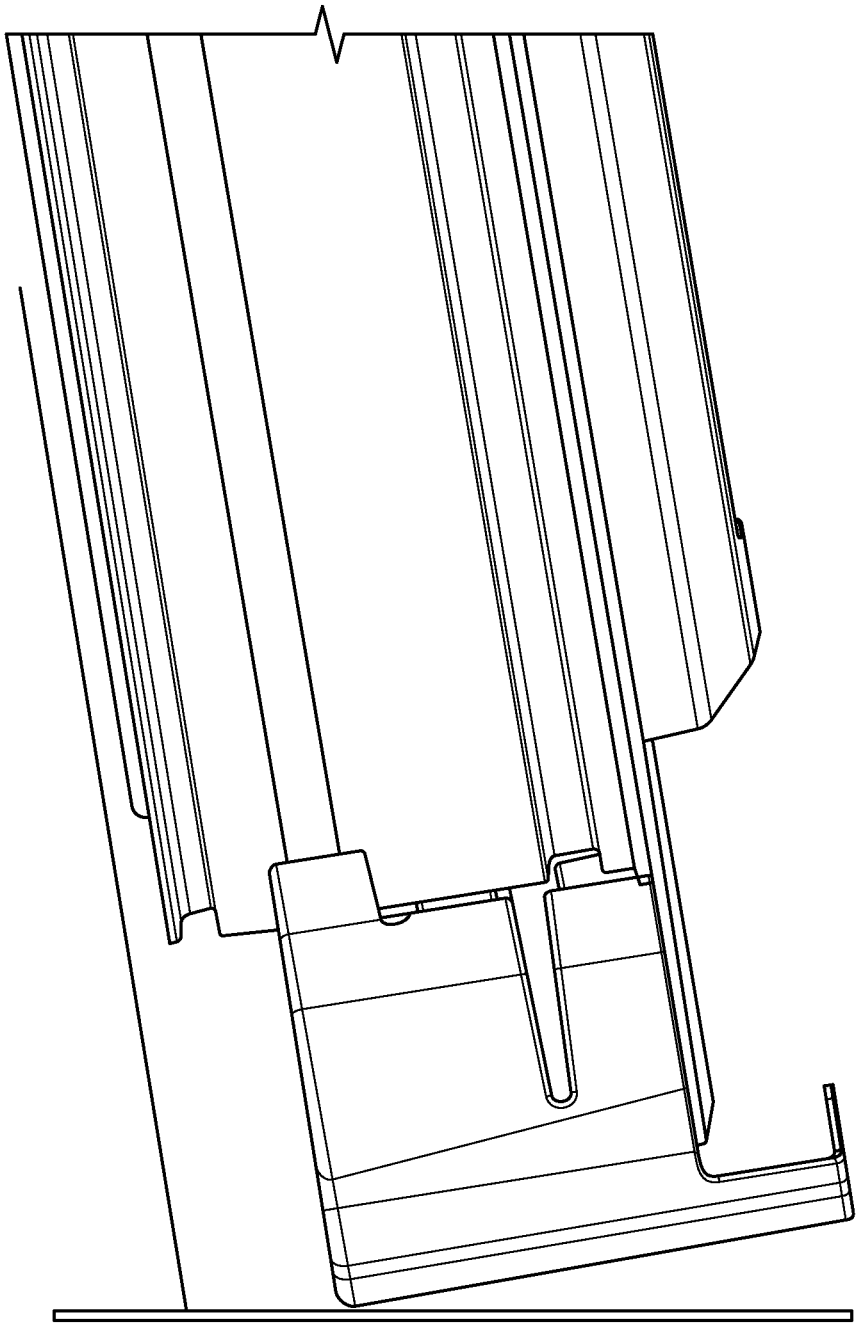
FIG. 25 is a schematic illustration of a shipping block under a vibrational test.

Referring now to FIG. 25, there is shown a schematic illustration of a vibrational test. In this test, the block is subjected to a vibration table testing for 24 hrs, with a 75 lbs. load at an angle of 7-10 degrees. Then, the block is tested at different temperatures: 70° F., at 120° F., and at 0° F. The shipping block passes the test if the block deflects, but there is no crack or breakage of any walls. The shipping block fails the test if there are any cracks or breakage of any walls.

Passage of these tests show that the blocks have good shock absorption, without any damage to the product being secured in the blocks.

While the invention has been described with reference to a preferred embodiment, it should be understood by those skilled in the art that various changes may be made and equivalents may be substituted for elements thereof without departing from the essential scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What we claim is:

1. A shipping block for packaging and shipping flat-panel products, the block (10, 110, 210, 310, 410, 510, 610, 710, 910) comprising:

a top face (12, 112, 912), a bottom face (14, 114, 914), a first end face (16, 116, 916), a second end face (18, 118, 918), and internal walls (60, 160);

wherein the top face (12, 112, 912) defines opposing first and second flexible alignment tabs (50, 150, 950);

the flexible alignment tabs (50, 150, 950) each having a first tab end (52, 152, 952) that extends from the first and second end faces (16, 116, 916), (18, 118, 918) at an acute angle from a plane defined by the top face (12, 112, 912); and, the flexible alignment tabs (50, 150, 950) each terminating at a second end (54, 154, 954), which has a downwardly-extending tab portion (56, 156, 956);

the bottom face (14, 114, 914) and the first end face (16, 116, 916) meeting at a first leading edge chamfer (22, 122, 922) which provides a sloping surface such that a transitional slope is defined between the first end face (16, 116, 916) and the bottom face (14, 114, 914, 1014);

the bottom face (14, 114, 914) and the second end face (18, 118, 918) meeting at an opposing, second leading edge chamfer (24, 124, 924), which also provides a sloping surface such that a transitional slope is defined between the second end face (18, 118, 918) and the bottom face (14, 114, 914);

the first and second leading edge chamfers (22, 122, 922 and 24, 124, 924, respectively) being configured to allow the block to slide across uneven surfaces;

the top face (12, 112, 912) defining first and second extending portions (26, 126, 926) and (28, 128, 928) in a spaced apart relationship with each other such that the first and second extending portions define a receiving slot (30, 130, 930); and, the internal walls (60, 160) extending from the top face (12, 112, 912) in a direction toward the bottom face (14, 114, 914); the internal walls (60, 160) having an arcuate shape; the internal walls (60, 160) being configured to flex when stress is applied to the bottom face (14, 114, 914) or the top face (12, 112, 912).

2. The shipping block of claim 1, wherein the receiving slot (930) includes a plurality of thin flexible protrusions (932) which are spaced along walls of the slot (930).

3. The shipping block of claim 1, wherein the bottom face (14, 114, 914) further defines a support platform (70) in a spaced apart relationship to the bottom face (14, 114, 914), the support platform (70) being configured to hold a section of the flat-panel secured by the block; the platform (70) extending in a generally planar direction from a plane defined by the bottom face (14, 114, 914).

4. The shipping block of claim 1, wherein at least a portion of the internal walls (160) of the block (110) at least partially extends from the top face (112) to the first or second end faces (116 or 118) at a point that is adjacent to the bottom face (114);

wherein the bottom face (114) and bottom portions of the internal walls (160) define an opening (170) that extends in a generally planar direction from a plane defined by the bottom face (114).

5. The shipping block of claim 1, wherein the shipping block (210) further includes opposing internal spring walls (280) having a first end (282) which extends from the bottom face (116) at an acute angle from a plane defined by the bottom face (114);

the internal spring walls (280) each terminating at a second end (284) at a point on a lower section of the internal walls (160);

wherein the internal spring walls (280) define one or more openings (286) within the block (210).

6. The shipping block of claim 1, wherein the shipping block (310) further includes opposing internal cross walls (380) having has a first end (382) which extends from the bottom face (116) at an acute angle from a plane defined by the bottom face (114);

the internal cross walls (380) each terminating at a second end (384) at a point on a lower section of the internal walls (160);

wherein the internal cross walls (380) define one or more openings (386) within the block (310).

7. The shipping block of claim 1, wherein the shipping block (410) further includes opposing internal laterally-extending walls (480) each having has a first end (480) which extends from the first end face (116) or the second end face (118) in a generally planar direction, as defined by the bottom face (114);

the internal laterally-extending walls (480) each terminating at a second end (484) at a point on the internal walls (162);

wherein the internal laterally-extending walls (480) define one or more openings (486) within the block (410).

8. The shipping block of claim 1, wherein the shipping block (510) further includes opposing internal laterally-extending walls (580) each having a first end (580) which extends from the first end face (116) or the second end face (118) in a generally planar direction, as defined by the bottom face (114);

the internal laterally-extending walls (580) each terminating at a second end (584) at a point on the internal walls (162);

wherein the internal laterally-extending walls (580) define one or more openings (586) within the block (510).

9. The shipping block of claim 8, wherein the shipping block (510) further includes opposing internal bracing walls (590) each having a first end (590) which extends from the first end face (116) or the second end face (118) in a generally planar direction, as defined by the bottom face (114);

the internal bracing walls (590) each terminating at a second end (594) at a point on the internal walls (162);

wherein the internal bracing walls (590) define one or more openings (596) within the block (510).

10. The shipping block (610) of claim 1, wherein the shipping block (610) further includes:

opposing internal laterally-extending walls (680), each internal laterally-extending wall (680) having a first end (682) which extends from the first end face (116) or the second end face (118) in a generally planar direction, as defined by bottom face (114); each internal laterally-extending walls (680) terminating at a second end (684) at a point on the internal walls (162);

wherein the internal laterally-extending walls (680) define one or more openings (686) configured to provide additional suspension and flex to the shipping block (610).

11. The shipping block of claim 1, wherein internal walls (160) each define a middle portion (166) configured to receive a clip (800).

12. The shipping block of claim 1, wherein the receiving slot (30, 130, 930) has a tapered dimension, such that the slot (30, 130, 930) is widest near the top face (12, 112, 912).

13. The shipping block of claim 1, wherein at least one of the first extending portions (26, 126, 926) and the second extending portions (28, 128, 928) further include a section of tape.

14. The shipping block of claim 13, wherein the tape section is two-sided such that a bottom of the tape section adheres to least one of the first extending portions (26, 126, 926) and second extending portions (28, 128, 928), while the tops of the tape section adhere to the flat-panel product being held within the block.

15. The shipping block of claim 1, wherein the block further includes one or more supporting extending walls (62, 162, 962) that extend from the internal walls (60, 160).

16. The shipping block of claim 1, wherein one or more supporting extending walls (62, 162, 952) extend from the internal walls (60, 160, 960) to provide internal support to the block.

17. The shipping block of claim 1, wherein the flat-panel products comprise at least one of a window, a glass sheet, a mirror, a door, entry doors, sliding doors, French patio doors, a composite sheet material, a shutter, a picture frame, a rock sheet material, and a circuit board.

18. The shipping block of claim 17, wherein when the product is a window, the alignment tabs (50, 150, 950) protect at least one nail fin of the window and, optionally at least one stucco flange of the window, from being damaged from the sides of the window hitting or running into other objects.

19. The shipping block of claim 1, wherein the alignment tabs (50, 150, 950) operate independently, such that the block can be used on any corner or along the sides of the products.

20. The shipping block of claim 1, wherein the alignment tabs (50, 150, 950) are configured to be capable of individually being pushed down flush to the top face (12, 112, 912, 1012) of the block such that the block can be used on either left or right corners and a center of the products.

21. The shipping block of claim 1, further including a clip (800) that has teeth (810) configured to hold the shipping block onto a window.

22. The shipping block of claim 21, wherein the clip (800) has a ramp member (820) configured to be pressed down into the shipping block.

23. A shipping block for packaging and shipping flat-panel products, the block (10, 110, 210, 310, 410, 510, 610, 710, 910, 1010) comprising:

a top face (12, 112, 912, 1012), a bottom face (14, 114, 914, 1014), a first end face (16, 116, 916, 1016), a second end face (18, 118, 918, 1018), and internal walls (60, 160);

the bottom face (14, 114, 914, 1014) and the first end face (16, 116, 916, 1016) meeting at a first leading edge chamfer (22, 122, 922, 1022) which provides a sloping surface such that a transitional slope is defined between the first end face (16, 116, 916, 1016) and the bottom face (14, 114, 914, 1014);

the bottom face (14, 114, 914, 1014) and the second end face (18, 118, 918, 1018) meeting at an opposing, second leading edge chamfer (24, 124, 924, 1024), which also provides a sloping surface such that a transitional slope is defined between the second end face (18, 118, 918, 1018) and the bottom face (14, 114, 914, 1014);

the first and second leading edge chamfers (22, 122, 922, 1022 and 24, 124, 924, 2014, respectively) being configured to allow the block to slide across uneven surfaces;

the top face (12, 112, 912, 1012) defining first and second extending portions (26, 126, 926, 1026) and (28, 128, 928, 1028) in a spaced apart relationship with each other such that the first and second extending portions define a receiving slot (30, 130, 930, 1030); and, the internal walls (60, 160) extending from the top face (12, 112, 912, 1012) in a direction toward the bottom face (14, 114, 914, 1014); the internal walls (60, 160) having an arcuate shape; the internal walls (60, 160) being configured to flex when stress is applied to the bottom face (14, 114, 914, 1014) or the top face (12, 112, 912, 1012);

wherein at least one of the internal walls (60, 160, 960, 1060) or one or more supporting extending walls (62, 162, 926, 1062) that extend from the internal walls (60, 160, 960, 1060) further define one or more openings (164, 964, 1064) that are configured allow a temporary screw to secure the shipping block to the flat-panel products.

* * * * *